US009316141B2

(12) United States Patent
Pilavdzic

(10) Patent No.: US 9,316,141 B2
(45) Date of Patent: Apr. 19, 2016

(54) ENGINE ENERGY MANAGEMENT SYSTEM

(71) Applicant: Enis Pilavdzic, Springfield, VA (US)

(72) Inventor: Enis Pilavdzic, Springfield, VA (US)

( * ) Notice: Subject to any disclaimer, the term of this patent is extended or adjusted under 35 U.S.C. 154(b) by 91 days.

(21) Appl. No.: 13/952,581

(22) Filed: Jul. 27, 2013

(65) Prior Publication Data

US 2014/0230761 A1 Aug. 21, 2014

Related U.S. Application Data

(60) Provisional application No. 61/850,445, filed on Feb. 15, 2013.

(51) Int. Cl.
*F01P 3/22* (2006.01)

(52) U.S. Cl.
CPC *F01P 3/2271* (2013.01); *F01P 3/22* (2013.01)

(58) Field of Classification Search
CPC ... F01P 3/2271; F01P 3/22; F01P 2003/2214; F01P 9/06
USPC ..... 123/41.2, 41.21
See application file for complete search history.

(56) References Cited

U.S. PATENT DOCUMENTS

| | | | | |
|---|---|---|---|---|
| 1,949,812 | A * | 3/1934 | Read | 123/41.02 |
| 2,180,760 | A | 11/1939 | Mayo | |
| 3,181,308 | A | 5/1965 | Vander Hagen | |
| 4,300,720 | A | 11/1981 | Baier et al. | |
| 4,860,951 | A | 8/1989 | Waas | |
| 4,976,463 | A | 12/1990 | Soo | |
| 5,031,579 | A | 7/1991 | Evans | |
| 5,305,823 | A | 4/1994 | Elliot | |
| 5,307,645 | A | 5/1994 | Pannell | |
| 5,333,678 | A | 8/1994 | Mellum et al. | |
| 6,138,468 | A | 10/2000 | Yokomachi et al. | |
| 6,278,083 | B1 | 8/2001 | Schwarz | |
| 6,772,602 | B2 | 8/2004 | Vetter et al. | |
| 6,866,092 | B1 * | 3/2005 | Molivadas | 165/104.21 |
| 6,932,148 | B1 | 8/2005 | Brummett et al. | |
| 7,066,245 | B2 | 6/2006 | Ebara et al. | |
| 7,178,358 | B2 | 2/2007 | Inaba et al. | |
| 7,353,661 | B2 | 4/2008 | Wang et al. | |
| 7,788,938 | B2 | 9/2010 | Baruschke et al. | |
| 8,156,754 | B2 * | 4/2012 | Hong et al. | 62/323.1 |

(Continued)

FOREIGN PATENT DOCUMENTS

| | | |
|---|---|---|
| CA | 2300683 | 11/2006 |
| CN | 2881413 Y | 3/2007 |

(Continued)

OTHER PUBLICATIONS

Brown, C. et al., Contracting Business: "Adding Heat Reclaim to Transcritical Carbon Dioxide Refrigeration." Retrieved from http://contractingbusiness.com/refrigeration/adding-heat-reclaim-transcritical-carbon-dioxide-refrigeration.

(Continued)

*Primary Examiner* — Lindsay Low
*Assistant Examiner* — Kevin Lathers
(74) *Attorney, Agent, or Firm* — Dowell & Dowell, PC

(57) ABSTRACT

An apparatus, comprising an engine, and an energy-management system configured to recirculate, at least in part, carbon dioxide relative to the engine in such a way that the carbon dioxide exchanges, at least in part, energy relative to the engine once the carbon dioxide is made to recirculate, at least in part, along the energy-management system.

28 Claims, 7 Drawing Sheets

(56) References Cited

U.S. PATENT DOCUMENTS

| | | | | |
|---|---|---|---|---|
| 8,397,506 | B1 | 3/2013 | Wright et al. | |
| 2003/0070849 | A1 | 4/2003 | Whittaker | |
| 2004/0055798 | A1 | 3/2004 | Almkermann | |
| 2005/0016723 | A1 | 1/2005 | Araki | |
| 2005/0198986 | A1 | 9/2005 | Allen | |
| 2005/0204768 | A1 | 9/2005 | Di Vito et al. | |
| 2006/0000594 | A1 | 1/2006 | Byon | |
| 2006/0075766 | A1 | 4/2006 | Claypole | |
| 2006/0196205 | A1 | 9/2006 | Ehlers et al. | |
| 2009/0139475 | A1* | 6/2009 | Roozenboom et al. | 123/41.71 |
| 2009/0301109 | A1 | 12/2009 | Manole | |
| 2010/0229577 | A1 | 9/2010 | Hong et al. | |
| 2010/0294217 | A1* | 11/2010 | Kasuya et al. | 123/41.55 |
| 2011/0192163 | A1 | 8/2011 | Kasuya | |
| 2011/0289953 | A1 | 12/2011 | Alston | |
| 2012/0023918 | A1 | 2/2012 | Laird et al. | |
| 2012/0210730 | A1 | 8/2012 | Pruett et al. | |
| 2012/0216536 | A1 | 8/2012 | Ma et al. | |
| 2012/0260640 | A1 | 10/2012 | Martin et al. | |

FOREIGN PATENT DOCUMENTS

| | | |
|---|---|---|
| DE | 10239877 | 3/2004 |
| EP | 2236803 | 6/2010 |
| JP | 2006329452 | 5/2005 |
| JP | 2008025973 | 2/2008 |
| KR | 1020080095635 | 10/2008 |
| SU | 1719694 | 3/1992 |

OTHER PUBLICATIONS

Nomerotski, A. et al., "Evaporative C02 cooling using microchannels etched in silicon for the future LHCb vertex detector." Retrieved from http://arxiv.org/ftp/arxiv/papers/121111211.1176.pdf.

Deutsche Umwelthilfe launches campaign to promote the use of C02 MAC for buses. (Jul. 17, 2013). Retrieved from http://www.r744.com/articles/4417/b__deutsche__umwelthilfe__launches__campaign__to__promote__the__use__of__co__sub__2__sub__mac__for__buses__b.

* cited by examiner

ENGINE ENERGY MANAGEMENT SYSTEM

CROSS REFERENCE TO OTHER APPLICATIONS

This patent application is a non-provisional patent application of prior U.S. Patent Application No. 61/850,445 filed Feb. 15, 2013. This patent application also claims the benefit and priority date of prior U.S. Patent Application No. 61/850,445 filed Feb. 15, 2013.

TECHNICAL FIELD

Aspects generally relate to (and are not limited to) an apparatus including an energy-management system for recirculating, at least in part, carbon dioxide relative to an engine. Other aspects relate to an apparatus having a cooling system configured to circulate a cooling medium relative to a heat-generating assembly of an engine.

BACKGROUND

An engine (of a vehicle), such as an internal-combustion engine (ICE), has a heat generating assembly, such as a combustion chamber. The combustion chamber facilitates combustion of a fuel (such as a fossil fuel) with an oxidizer (such as air). The combustion chamber may be recessed in a cylinder head of the engine and contains an intake valve and an exhaust valve. Some engines use a dished piston and in this case, the combustion chamber is a part of a cylinder that slidably receives the dished piston. After fuel ignition, the combusting fuel and oxidizer mixture acts upon the piston in such a way as to push the piston in a direction of the expending combusting gas (fuel).

In the internal-combustion engine, the expansion of the high-temperature and high-pressure gases produced by combustion (in the combustion chamber) apply a direct force to a movable component (such as a piston assembly) of the engine. This force moves the component over a distance, transforming chemical energy into useful mechanical energy. The term internal-combustion engine usually refers to an engine in which combustion is intermittent, such as the four-stroke piston engine and/or the two-stroke piston engine, along with variants, such as the six-stroke piston engine and the Wankel rotary engine and equivalents thereof.

Another class of internal-combustion engines use continuous combustion: gas turbines, jet engines, and rocket engines, each of which are internal-combustion engines that are configured to operate under the same principle as previously described. The internal-combustion engine is different from known external-combustion engines, such as the steam engine or Stirling engines, in which the energy is delivered to a working fluid (cooling medium) not consisting of, mixed with, or contaminated by combustion products. Working fluids can be air or some noble gases, hot water, pressurized water or even liquid sodium, heated in some kind of boiler. Internal-combustion engines are usually powered by energy-dense fuels such as gasoline or diesel, or liquids derived from fossil fuels. While there are many stationary applications, most internal-combustion engines are used in mobile applications and are the dominant power supply for cars, aircraft, and boats.

Two common forms of engine cooling are air-cooled and water-cooled. Most modern engines are water-cooled. Some engines (air cooled or water cooled) also have an oil cooler. Cooling is required to remove excessive heat from the engine. Over-heating of the engine may cause engine failure, usually from wear, cracking or warping. The term "internal-combustion engine cooling" refers to the cooling of the internal-combustion engine, typically using either air or a liquid. Typically, internal-combustion engines of a car may use water for cooling (if so desired).

Heat engines (also known as the engine or the internal-combustion engine, etc.) generate mechanical power by extracting energy from expanding gas generated by internal combustion, much as a water wheel extracts mechanical power from a flow of mass falling through a distance. Because of the enclosed combustion process, an engine of a car (vehicle) operates inefficiently, so considerably more fuel chemical energy enters the engine than comes out as mechanical power; the difference is waste heat that must be removed. The internal-combustion engine is configured to remove waste heat through heat absorption by cool intake air, quick removal of hot exhaust gases, explicit engine cooling and by simply radiating energy from a highly conductive engine block and associated connections. Lubricating oil removes a relatively small portion of engine heat as well. Engines with a higher efficiency have more energy that leaves as mechanical motion and less as waste heat.

Some waste heat may be removed from the cabin of the automobile (vehicle), so that the driver (vehicle operator) is comfortable during prolonged driving in a relatively higher environmental temperature. This heat is considered lost since a compressor driven by an engine shaft directly removes this energy. Passenger-cabin cooling is a feature of a vehicle, and may be supplied as a standard option.

Heat engines need cooling to operate properly. Cooling is also needed because high temperatures may lead to inadvertent damage to engine materials and lubricants. Internal-combustion engines burn fuel hotter than the melting temperature of engine materials, and hot enough to set fire to the lubricants. Engine cooling removes energy fast enough to keep temperatures low so the engine can survive and operate reliably. Good control over the operating temperature of the engine is an important aspect for engine performance and efficiency.

Some high-efficiency engines operate without explicit cooling, and with only accidental heat loss in accordance with a design called adiabatic. For example, 10,000 mile-per-gallon cars are insulated; both to transfer as much energy as possible from hot gases to mechanical motion, and to reduce reheat losses when restarting. Such engines can achieve high efficiency by impacting power output, duty cycle, engine weight, durability, and/or emissions.

Most internal-combustion engines are fluid cooled using either air (a gaseous fluid) or a liquid coolant that runs through a heat exchanger (radiator) cooled by air. Marine engines and some stationary engines have ready access to a large volume of water at a suitable temperature. The water may be used directly to cool the engine, but often has sediment that may inadvertently clog coolant passages, or chemicals, such as salt, minerals and deposits that can chemically damage the engine. Thus, engine coolant may be run through a heat exchanger that is cooled by the body of water in order to avoid inadvertent damage in the engine.

Most liquid-cooled engines use a mixture of water and chemicals such as antifreeze and rust inhibitors. The term for the antifreeze mixture is engine coolant. Some antifreezes use no water at all, instead using a liquid with different properties, such as propylene glycol or a combination of propylene glycol and ethylene glycol. Most air-cooled engines use some liquid oil cooling, to maintain acceptable temperatures for both critical engine parts and the oil itself. Most liquid-cooled engines use some air cooling, with the intake stroke of air used for combustion. The heat energy absorbed by cold intake air is lost energy, and is not recovered due to heating of the intake air. Gaseous cooling for the engine is not capable, by sensible heat only, to remove all the heat generated by the internal-combustion process. Water has high-heat capacity and is a good coolant medium. Water requires large-size conductive channels so that the water may flow freely within the engine block. The water cooling operates at the very critical temperature, close to 100 degrees Centigrade when water boils. Boiling water is undesirable for engine cooling. This very nature of current ICE cooling, operating around water critical point, may be limiting.

There are many demands on a cooling system of the engine. One requirement is that an engine may fail if just one part of the engine overheats. Therefore, it is vital that the cooling system of the engine keeps all parts of the engine at suitably stable temperatures and at an efficient operating point. Liquid-cooled engines are able to vary the size of their passageways through the engine block so that coolant flow may be tailored for the needs of each area. Locations with either high peak temperatures (narrow islands around the combustion chamber) or high-heat flow (around exhaust ports) may require generous cooling. This reduces the occurrence of hot spots, which are more difficult to avoid with air cooling. Air-cooled engines may also vary their cooling capacity by using more closely spaced cooling fins in that area, but this can make their manufacture difficult and expensive. Besides, cooling air temperature may very significantly during engine operation.

Some parts of the engine, such as the engine block and head, are cooled directly by the main coolant system. Moving parts such as the pistons, and to a lesser extent the crank and rods, must rely on the lubrication oil as a coolant, or to a very limited amount of conduction into the engine block and thence the main coolant. High-performance engines frequently have additional oil, beyond the amount needed for lubrication, sprayed upwards onto the bottom of the piston just for extra cooling. This oil is then air cooled via air heat exchanger. Therefore, the heat energy is expelled into an environment and is not recovered.

Liquid-cooled engines usually have a circulation pump. The first engines relied on thermo-syphon cooling alone, where hot coolant left a top of the engine block and passed to the radiator, where it was cooled before returning to the bottom of the engine. Circulation was powered by convection alone.

Other demands include other factors such as cost, weight, reliability, and durability of the cooling system itself. Cooling with water requires large liquid channels, and that makes engine coolant-fluid containment relatively bigger and heavier. This adds weight to moving vehicles and adds to overall burden to engine efficiency, and lowers fuel efficiency of the car.

Conductive heat transfer is proportional to the temperature difference between materials. If the engine metal is at 250° C. (degrees Centigrade) and the air is at 20° C., then there is a 230° C. temperature difference for cooling. An air-cooled engine uses all of this difference. In contrast, a liquid-cooled engine might dump heat from the engine to a liquid, heating the liquid to 135° C. (the standard boiling point of water is 100° C. and can be exceeded as the water cooling system is allowed to be both pressurized, and uses a mixture with anti-freeze) which is then cooled with 20° C. air. In each step, the liquid-cooled engine has half the temperature difference and so at first appears to need twice the cooling area.

However, properties of the coolant (water, oil, or air) also affect cooling. For example, comparing water and oil as coolants, one gram of oil can absorb about 55% of the heat for the same rise in temperature (called the specific heat capacity). Oil has about 90% the density of water, so a given volume of oil can absorb only about 50% of the energy of the same volume of water. The thermal conductivity of water is about four times that of oil, which can assist in heat transfer. The viscosity of oil can be ten times greater than water, increasing the energy required to pump oil for cooling, and reducing the net power output from the engine.

Comparing air and water, air has a vastly lower heat capacity per gram and per volume, and less than a tenth the conductivity, but also much lower viscosity (about 200 times lower). Therefore, air-cooling needs ten times the surface area, therefore, the fins, and the air needs about 2000 times the flow velocity and thus the recirculating air fan may need ten times the power of a recirculating water pump. It may be desirable to eliminate cooling fans and coolant pumps (to improve reliability of the engine).

Moving heat from the cylinder to a large surface area for air cooling can present problems such as difficulties associated with manufacturing the shapes needed for good heat transfer and the space needed for free flow of a large volume of air. Water boils at about the same temperature desired for engine cooling. This has the advantage that it absorbs a great deal of energy with a relatively little rise in temperature (called the heat of vaporization), which is good for keeping things cool; however, this is not utilized for cooling internal-combustion engines due to size and weight requirements. In moving vehicles, this may also be very inefficient.

In contrast, passing air over several hot objects in series warms the air at each step, so the first step may be over-cooled and the last step may be under-cooled. However, once water boils, if vaporized water is not removed and cooled, it acts an insulator, leading to a sudden loss of cooling where steam bubbles form; unfortunately, steam may return to water as it mixes with other coolants, so an engine temperature gauge can indicate an acceptable temperature even though local temperatures are high enough that damage is done to the engine.

The parts of the engine need different temperatures. For example, the inlet includes a compressor of a turbo, inlet trumpets, inlet valves that need to be as cold as possible for proper operation. A countercurrent heat exchange with forced cooling air may assist in this requirement. The cylinder-walls should not heat up the air before compression, but also not cool down the gas in the combustion chamber. Operating temperature of the internal-combustion engine is set due to limits of cooling water and not due to efficiency of energy conversion. Since water is used for cooling with boiling temperature at 100° C., a compromise is established so that a cylinder wall temperature is around 90° C. Then, the viscosity of the oil is optimized for just this temperature. Any cooling of the exhaust and the turbine of the turbocharger reduces the amount of power available to the turbine, so the exhaust system is often insulated between engine and turbocharger to keep the exhaust gases as hot as possible.

The temperature of the cooling air may range from well below freezing to 50° C. Further, while engines in long-haul boat or rail service may operate at a steady load, road vehicles often see widely varying and quickly varying load. Thus, the cooling system is designed to vary cooling so the engine is neither too hot nor too cold. Cooling-system regulation includes adjustable baffles in the air flow (sometimes called shutters and commonly run by a pneumatic shutter). A fan operates either independently of the engine, such as an electric fan, or which has an adjustable clutch. A thermostatic valve (also called a thermostat) can block the coolant flow when conditions are too cool. In addition, the motor, coolant, and heat exchanger have some heat capacity, which smoothens out temperature increase in short sprints. Some engine controls shut down an engine or limit engine operation to half throttle if the engine overheats. Some electronic engine controls adjust cooling based on a throttle condition to anticipate a temperature rise, and limit engine power output to compensate for finite cooling. Accurate engine temperature control is relatively nonexistent.

It is usually desirable to minimize the number of heat transfer stages in order to maximize the temperature difference at each stage. However, some diesel two-stroke cycle engines use oil cooled by water, with the water in turn cooled by air. The coolant used in many liquid-cooled engines must be renewed periodically, and can freeze at ordinary temperatures thus causing permanent engine damage.

Cars and trucks using direct air cooling (without an intermediate liquid) were built over a long period from the very beginning, and ending with a small and generally unrecognized technical change. Before World War II, water-cooled cars and trucks routinely overheated while climbing mountain roads, creating geysers of boiling water. This was considered normal, and at the time, most noted mountain roads had auto repair shops to minister to overheated engines.

During that period, some car manufacturers built diesel trucks, farm tractors, and passenger cars that were air-cooled. Air-cooled engines may be adapted to extremely cold and hot environmental weather temperatures. Air-cooled engines may start and run in freezing conditions (in which water-cooled engines cannot since they may become stuck), and continue working when water-cooled engines start producing unwanted leakage in the form of steam jets. Furthermore, with the possibility of working at higher temperatures, air-cooled engines may have an advantage from a thermodynamic point of view. A problem met in air-cooled aircraft engines was the so-called shock cooling when an airplane entered in a dive after climbing or leveled flight with the throttle opened. With the engine under no-load while the airplane dives, the engine generates less heat, and the flow of air that cools the engine is increased. A catastrophic engine failure may result as different parts from the engine have different temperatures, and thus different thermal expansions. In such conditions, the engine may get stuck or seize, and any sudden change or imbalance in the relation between heat produced by the engine and heat dissipated by cooling may result in an increased wear in the engine, as a consequence also of thermal dilatation differences between parts from the engine may cause the engine to inadvertently crack.

Liquid cooled engines have more stable and uniform working temperatures, and are less susceptible to variation in air temperatures. Most engines are liquid-cooled. Liquid cooling is also employed in maritime vehicles (vessels). For vessels, the seawater, itself is mostly used for cooling. In some cases, chemical coolants are also employed (in closed systems), or they are mixed with seawater cooling. While liquid cooling in general has some advantages, it may require larger cooling passages and tends to operate at the smaller temperature differential. As well, the optimal operating temperature of the engine may be outside the water cooling operating range.

The change from air cooling to liquid cooling occurred at the start of World War II when the military needed more reliable vehicles. The subject of boiling engines was addressed, researched, and a solution was found. Previous radiators and engine blocks were properly designed and survived durability tests, but used water pumps with a leaky graphite-lubricated rope seal (gland) on a pump shaft. The seal was inherited from steam engines, where water loss is accepted since steam engines already expend large volumes of water. Because the pump seal leaked mainly when the pump was running and the engine was hot, the water loss evaporated inconspicuously, leaving at best small rusty traces when the engine stopped and cooled, thereby not revealing significant water loss. Automobile radiators (or heat exchangers) have an outlet that feeds cooled water to the engine, and the engine has an outlet that feeds heated water to the top of the radiator. Water circulation is aided by a rotary pump that has only a slight effect, having to work over such a wide range of speeds that its impeller has only a minimal effect as a pump. While running, the leaking pump seal drained cooling water at a level where the pump could no longer return water to the top of the radiator, so water circulation ceased and water in the engine boiled. However, since water loss led to engine overheating and further water loss from boil-over, the original water loss was hidden.

After isolating the pump problem, cars and trucks built for the war effort were equipped with carbon-seal water pumps that did not leak and caused fewer inadvertent geysers. Meanwhile, air cooling advanced in memory of boiling engines even though boil-over was no longer a common problem. Air-cooled engines became popular throughout Europe. As air quality awareness rose in the 1960s, and laws governing exhaust emissions were passed, unleaded gas replaced leaded gas, and leaner fuel mixtures became the norm. These reductions in the cooling effects of both the lead and the formerly rich fuel mixture, led to overheating of the air-cooled engines. Valve failures and other engine damage resulted. One manufacturer responded by abandoning their (flat) horizontally opposed air-cooled engines, while another manufacturer chose liquid cooling for their engine when it was introduced.

However, many motorcycles use air cooling for the sake of reducing weight and complexity. Some automobiles have air-cooled engines, but historically, it was common for many high-volume vehicles to be preferably cooled by air.

Most aviation piston engines are air-cooled, including most of the engines currently manufactured and used by major manufacturers of aircraft but there are some exceptions.

Other engine manufacturers use a combination of air-cooled cylinders and liquid-cooled cylinder heads.

SUMMARY

I, the inventor, have researched a problem associated with engines in general. After much study, I believe I have arrived at an understanding of the problem and its solution, which are stated below. The state of the art appears to identify many options for potential solutions, but the problems appear to persist anyway.

There appears to be an opportunity for better engine temperature control and/or engine efficiency improvements. Management of temperature of the internal-combustion engine, of significant heat losses resulting from irreversibility associated with very poor energy conversions are important factors. There are known engines where irreversible heat generation resulting from the energy conversion process may be improved. Utilizing a liquid-gas phase change may allow for improved temperature control of the engine with an optional additional benefit of allowing for some energy previously deemed waste energy to be partially recovered and reused.

In one form, the current state of the art (in automotive industry related to the internal-combustion engine) has relatively poor overall efficiency for fuel conversion factor over a range from about 20% to about 40% of fuel-energy content. Some engines operate currently at about 20% fuel-to-wheel efficiency. The efficiency of the engine is a ratio of the power at the wheels to the energy in the fuel used to feed the engine. The best ratio today is in the range of about 38% to about 54% largely dependent upon the engine type. To better relate this to common driving conditions, a medium-sized car converts about 74% of the fuel energy into heat, which is classified as non-propelling energy (that is, energy wastage). High-energy efficiency is important for low fuel consumption and for savings in the cost of hydrocarbon fuel and in reduced environmental impact. The carbon dioxide and sulphur emissions (arising from fuel consumption by the vehicle) are directly related to fuel consumption. Various techniques are used to increase efficiency of the internal-combustion engine. Some methods use exhaust gas kinetic energy to increase air intake pressure (such as, turbochargers). Other methods use engine power to compress the intake air, and these are known in the art as superchargers. Both methods aim to increase the compression ratio to improve fuel conversion efficiency of the engine. Increasing the compression ratio may be done by tapping into the mechanical power of the engine, and improving poor air-fuel mixture (reducing fuel knocking) reduces the torque of the engine, and this may be a major obstacle for better fuel economy of the automobile. Other methodologies in the automobile art may be used to improve automobile efficiency. No small steps are being taken to reduce engine driving loads as well as automobile parasitic loads. Vehicle parts are lightened to reduce the weight of the moving mass of the vehicle. Electrical demand on automobiles has been increasing steadily and represents a large parasitic load on the engine as well. Charging of the battery of an engine demand more and more energy that is not used to propel the car (vehicle solely driven by the internal-combustion engine). Further efforts are made in reducing overall weight of the automobile chassis with aim to reducing energy demand as well as optimizing a shape of the automobile to reduce the total aerodynamics drag of a vehicle; this may include optimization of many factors such as profile drag, induced drag, skin friction drag, interference drag and cooling and ventilation system drag. Currently, the air water heat exchanger is usually frontally located forcing car designs around the optimal aerodynamic form. If cooling other than water is used, and larger portion of the heat generated by the internal-combustion engine is recovered, then only portion of the heat energy will be dissipated into environment and perhaps different shape and streamlined form of the air heat exchanger may be used. For example, the action of dissipation of heat may be done to the environment unassisted.

There may be a need to improve engine cooling, car cooling, and ventilation. Energy required for cooling of the engine, and heating and cooling of the passenger cabin is another additional demand on the overall automobile efficiency. Currently, the engine is cooled by water in a conduction mode only. As well, water evaporative cooling is not used for heat removal in current state of the art.

U.S. Pat. No. 7,353,661 discloses engine cooling and energy capture and recovery, and identifies dual cooling loops configured to remove energy from hot water or working fluid.

United States Patent Publication Number 2011/0192163 discloses usage of the classical Rankine cycle to recover heat energy from the internal-combustion engine but still uses multiple cooling loops and multiple working fluids in elaborate control schemes not addressing the issue of engine cooling and temperature control.

United States Patent Publication Number 2012/0260640 discloses an apparatus configured for exhaust heat recovery. The apparatus is fluidly connected to a heat exchanger, and is devised to control energy recovery when heat is available but not in a continuous way.

The recovery of the energy captured by water as a cooling medium is less cost effective because recovery at small temperature delta differentials requires large heat exchangers and devices that are not practical for moving applications (vehicles).

Therefore, there is a need to provide improved or better cooling of the engine or of heat sources of various types associated with the engine. As well, it may be advantageous to reclaim waste heat potentially available as unrecovered energy.

In order to mitigate, at least in part, some of the problems identified above, in accordance with an aspect of my work, I (the inventor) have developed an apparatus, comprising a movable vehicle. The movable vehicle includes a heat-generating assembly. The heat-generating assembly is configured to generate heat once actuated to do just so. A cooling system is configured to circulate a cooling medium having the carbon dioxide relative to the heat-generating assembly. This is done in such a way that the carbon dioxide conveys heat from the heat-generating assembly to the cooling medium. The cooling medium transports the heat away from the heat-generating assembly.

In order to mitigate, at least in part, some of the problems identified above, in accordance with an aspect of my work, I (the inventor) have developed a method comprising circulating a cooling medium having the carbon dioxide relative to a heat-generating assembly of an engine. This is done in such a way that the carbon dioxide conveys heat from the heat-generating assembly to the cooling medium. The cooling medium transports the heat away from the heat-generating assembly.

In order to mitigate, at least in part, some of the problems identified above, in accordance with other aspects of my work, I (the inventor) have developed and provided an apparatus, including an internal combustion engine including: a heat-generating assembly; and a cooling system. The cooling system is configured to be positioned relative to the heat-generating assembly. The cooling system is configured to recirculate a cooling medium having carbon dioxide relative to the heat-generating assembly in such a way that the carbon dioxide conveys heat from the heat-generating assembly to the cooling medium, and the cooling medium transports the heat away from the heat-generating assembly.

In order to mitigate, at least in part, some of the problems identified above, in accordance with other aspects of my work, I (the inventor) have developed and provided an apparatus, including an engine being configured to generate energy having a first amount of the energy being usable, at least in part, for performing work, and also having a second amount of the energy not being useable, at least in part, to perform the work, the apparatus also includes an energy-management system configured to recirculate, at least in part, carbon dioxide relative to the engine in such a way that the carbon dioxide exchanges, at least in part, the second amount of the energy not being useable to perform the work once the carbon dioxide is made to recirculate, at least in part, along the energy-management system. In use, the energy-management system recirculates, at least in part, the carbon dioxide.

In order to mitigate, at least in part, some of the problems identified above, in accordance with other aspects of my work, I (the inventor) have developed and provided an apparatus including an engine, and an energy-management system. The energy-management system is configured to recirculate, at least in part, carbon dioxide relative to the engine in such a way that the carbon dioxide exchanges, at least in part, energy relative to the engine once the carbon dioxide is made to recirculate, at least in part, along the energy-management system.

In order to mitigate, at least in part, some of the problems identified above, in accordance with other aspects of my work, I (the inventor) have developed and provided other aspects as provided in the claims.

Other aspects and features of the non-limiting embodiments may now become apparent to those skilled in the art upon review of the following detailed description of the non-limiting embodiments with the accompanying drawings.

In some aspects, a structure and/or an apparatus is configured to cool the engine that may result in significant mass reduction and/or elimination of toxic coolants and/or associated hardware, as well as improving engine cooling without the possibility of the coolant freezing at extreme temperatures. It is a common practice today that air conditioning of the passenger cabin of the vehicle is done by the air-conditioning modules directly operated by the internal-combustion engine. These climate control systems may include a compressor configured to compress a cooling medium, an evaporator configured to absorb the heat, and/or a condenser (a gas cooler) configured to remove heat from the cooling fluid; these assemblies are configured to remove heat from the passenger cabin of the automobile, or to supply heat to the cabin.

U.S. Pat. No. 6,138,468 (also published as European Patent Number 0935107) discloses a cooling system powered by the internal-combustion engine, and uses a carbon dioxide refrigerant. The cooling system is configured to cool the passenger compartment of the vehicle.

U.S. Pat. No. 8,156,754 discloses an internal heat exchanger configured to speed up engine heat-up time and improve cooling of the engine in a separate cooling medium.

U.S. Pat. No. 7,066,245 discloses management of automobile cooling and heating, in which cabin heating and cooling are done by opening and closing intake air channels and diverting heat outside of the car or in the cabin.

To date, the engine is cooled by water or by a combination of water and freeze-prevention additives that limit engine temperature to the boiling point temperature of the cooling medium. The maximum operating temperature may be 125 degrees centigrade, and this appears to be the operating temperature of the most automobile engines. A cooling loop is used to cool the internal-combustion engine. It may be desirable to cool the piston blocks (engine block that forms piston cylinders that each operatively receives and accommodates a respective piston), and/or piston head, and/or a valve gate housing. The known systems provide temperature control of the engine that has not been improved much from early automobile production. A thermostat, mechanical in nature, controls the flow of the cooling-water mixture through the engine passages, and variation in temperature throughout the water-cooled loop is unpredictable and largely uncontrolled. Besides, water heat absorption is a sensible process with 1 kilogram (kg) water absorbs about 25 kilojoules (kJ) of heat for the temperature difference of 5 degrees Centigrade. An order of magnitude more heat, 250 kJ, can be removed when boiling process with sensible and latent heat is utilized.

Efficiency of the operating cycle in the internal-combustion engine may be determined by operating temperatures and pressures. In light of the above drawbacks, some aspects provide aspects of an apparatus that are configured to control temperature of an engine (or engine components independently from each other), and/or optionally profile the temperature across the engine in such a way that efficiency and engine performance may be increased at least in part.

In some aspects, the apparatus provides, at least in part, improved utilization (reuse) of the heat (thermal) energy provided by the internal-combustion engine. By reusing the heat energy (previously considered not-recoverable energy), overall efficiency of the internal-combustion engine may be improved (at least in part), and the negative environmental impact of automobiles may be reduced as well (at least in part).

U.S. Pat. No. 7,178,358 (also published as European Patent Number 1441121) discloses a method for recovering some heat removed from the engine and heat removed from the exhaust systems by using a heater in an interface between two cooling loops. The cooling loop circulates water, and a vapor compression loop is used for cooling the car interior; the loops are thermally connected via heat exchanger. European Patent (EP) Number 1441121 discloses an arrangement in which a limited amount of energy can be recovered due to nature of the water-cooling circuit operating at the small temperature differential.

Therefore, there may be a need to improve heat recovery from the internal-combustion engine, the passenger cabin and other associated equipment and payloads where excess heat is available.

An aspect provides an apparatus configured to provide temperature control of the internal-combustion engine by way of a cooling medium where sensible and latent heat of the cooling medium is used to remove heat from the internal-combustion engine.

A further aspect provides an apparatus configured to cool a part of the engine with different cooling flow to vary the temperature according to engine demand for maximum efficiency of operation and with thermal relationship, thereby improving (at least in part) engine conversion efficiency of the chemical energy of the fuel to mechanical-motive energy.

A further aspect provides an apparatus configured to remove heat from the engine and/or from the cabin in a closed coolant flow, and convert this heat energy into one of the usable energy forms (means) such as electrical, mechanical or chemical via a well-known expansion device.

A further aspect provides an apparatus configured to combine, via a heat exchanger, heat recovered from the internal-combustion engine and/or heat exhausted from the internal-combustion engine, and possibly heat from the passenger cabin in such a way as to use this combined source of recovered energy (in a meaningful way) to generate energy. To date, these sources of energy have been mostly dumped in the environment, and for the internal-combustion engine this may amount to over 70% of the utilized fuel energy content. In an embodiment, the engine block of the internal-combustion engine (ICE) is configured to have at least one or more suitably placed piston sleeves made with a plurality of fluid camels suitably sealed with multiple entry points and exit points in such a way that the engine block has independently temperature-controlled zones. A set of valves located upstream of the fluid channels may be used to control fluid delivery responsive to temperature control. Temperature control loops are responsive to temperature feedback sensors, at least one, mounted in the selectively placed location of the cylinder sleeve where cooling or heating temperature may be maintained with considerable accuracy not possible with thermostatically controlled water valve known in the prior art. In some arrangements, at least one valve is equipped with pressure reducing element. The plurality of elements is envisioned as well. Electrostatic or electronic controls of the valves are possible and are not limited to simple pressure drop created by micro tube of suitable diameter for the demanded flow rate of the coolant and required pressure drop. A pressure-reducing device is suitably configured to receive coolant and vaporize at least a portion of the coolant or produce the fine particles of liquid droplets in average size at least less than 200 micrometers. The mixture of liquid droplets and vapor is sprayed over component to maintain desired engine temperature by absorbing heat into a cooling fluid.

In some embodiment, engine cylinder temperature may be profiled to enhance fuel-burning characteristic and improve gas-expanding force at the tail end of the fuel burn, improving engine efficiency.

In some embodiments, the engine cylinder is configured to allow for a smooth sliding surface for piston with close tolerances to slide freely at predetermined operating temperatures, and to slide freely in close tolerances during heat up time of the internal-combustion engine (ICE).

In some embodiments, an inner surface of the piston pathway is configured to control temperature of the inner surface by combining in suitable ways, pressure resistant sealed volume for the cooling medium to flow and expand into gases state within confines of the sleeves. The cylinder sleeve or any heated surface, in some arrangements, is made of high thermally conductive material to facilitate the flow of the heat from the inner surface of the heat generating means to the interior with large contact surface for heat flow and transfer where heat can be absorbed by the coolant.

In some embodiments, the sleeve arrangement contains fluid in the inner space within sub-surface passageways, channels, macro channels, micro channels, and/or open pores suitably arranged to facilitate a flow of the cooling medium in a liquid, gas or liquid-gas mixture. The cooling medium, in at least one fluid passageway or channel, is in fluid communications with a source of the high-pressure coolant where the working coolant medium is in a gas state and/or in a gas-liquid state of carbon dioxide. The high thermally conductive material (with open channel passages) allows for the working fluid to expand. The working fluid can flow, evaporate and fill the working volume of the coolant to the certain optimal pressure level above atmospheric pressure. This working volume can be an alloy of copper or aluminum, and/or as carbon-fiber structure with highly conductive nano-tubes integrated in a web of the fibers.

Generally speaking, a cooling medium (working fluid) includes carbon dioxide and any equivalent thereof, such as a synthetically derived single or multi-component refrigerant with similar heat removal capacity as carbon dioxide.

In some embodiments, at least one temperature sensor is used in electrical communications with a temperature control unit, in communication with a pressure-reducing valve and/or an injector valve to optimally vary flow of the coolant in a proportionality to set temperature and engine efficiency and power demands. In some aspects of the apparatus, the pressurized coolant is supplied and used in a closed loop. In some embodiments, other parts of the engine block are provided with a suitable set of fluidal containment channels in communications with pressure reducing supply valve and in communications with a temperature sensor and with a temperature control unit to suitably maintain set point temperature of the engine part and/or the engine volume portion.

In some arrangements, the cooling medium is of high pressure and is contained and allowed to expand in a second out-flow passage to be collected once completely evaporated and delivered with some driving pressure to the intake of the compressor units that compress the suitable gas, with absorbed energy content, into a smaller volume. Once compressed fluid evaporates, and is enriched with heat energy and removed from the heated areas, it is now ready to let go of that energy at relatively high temperatures. The heat movement is directly proportional with differential temperature. Due to large temperature increase, energy can be recovered with minimal cost and volume. This heat energy can be recovered and used on the number of ways. Primarily, it is possible to add more heat from the internal-combustion engine gained from the exhaust system and combine exhausted energy at the exhaust manifold and energy from other heat sources, i.e. cabin internal cooling, fuel cell heat, etc., by using the energy recovery heater (ERH). This may be a significant amount of available energy with high pressure to be recovered. Potentially, from about 50% to about 70% fuel energy is consumed. The recovered energy, in some embodiments, can be used to pressurize and compress intake air and increase engine power in well-known ways in the state of the art (i.e. superchargers and turbochargers).

In some embodiments, energy is captured via a turbine expender, and energy gain by this way is converted to electrical energy, mechanical energy and/or chemical energy. In this stage, in some embodiments, recovered energy can be used in the electric form to charge batteries in a hybrid vehicle. In another form, energy can be stored in mechanical, electrical and/or chemical energy storage, and used where the engine operator requests demand for a particular type of power.

In some embodiments, once, energy is recovered from the fluid, the working fluid (cooling medium) is further sensibly cooled to environmental temperature and additionally super cooled before delivery to pressure-reducing valves to be evaporated (and the cycle may be repeated). The cycle steps are: working medium/refrigerant is compressed, preheated, expanded, cooled, and depressurized to evaporate and absorb new heat, and then recompressed again in the continuous cycle. This cycle of energy absorption and recapturing is driven, in some embodiments, by the engine itself. In some embodiments, the electric motor powered from the storage of the electric or mechanical energy, alternatively via chemical energy after reconversion to electric energy, may drive this continual cycle of heat capturing and heat recovery in a thermodynamic cycle for carbon dioxide being cooled in a supercritical state.

In some embodiments, valve seats and exhaust ports in the head of the engine are cooled by the working fluid (the cooling medium) in communications with a pressure-reducing valve (means) in electrical communications with a temperature controller that is configured to control the pressure-reducing valves based upon the signal provided by the temperature sensor in communications with a temperature controller. The temperature sensor is suitable mounted or attached to sense the temperature of that zone. The temperature sensor may include any sort of temperature detecting means (such as thermocouple, thermistor, thermostat, etc.).

In some embodiments, the working fluid (the cooling medium) may be used to pre-heat engine parts to speed up the warm-up of the engine, and also may be used to heat up the cabin of the vehicle or vehicle driving parts or payloads as required. Where heat exists in one part of the vehicle, the heat can be captured by this embodiment and transferred and released or captured and stored as reusable energy.

In other embodiments, additional supercritical vapor cycles may be used for cooling passenger compartments where common components of the cooling loops are shared.

In other embodiments, the internal-combustion engine (and any equivalent thereof) may have or provide a combination of a cooling assembly, and a heat-recovery system configured for direct reclamation of heat generated by the internal-combustion engine. This may be accomplished in a single cooling and thermodynamic trans-critical cycle utilizing an organic, natural and readily-available medium such as carbon dioxide as the cooling medium (the working fluid). The working fluid is delivered via fluidic channels and/or micro bubbles dispensed in a controlled manner and placed in thermal communications with a heat source. Heat energy in a gaseous phase of the working fluid is compressed to obtain supercritical state, and add heat by the additional heat sources (such as exhaust, or cabin heat) suitably delivered to an expander, and in this way energy recovery may be performed. The process is continuous and energized by the heat source itself or by the other onboard energy sources. Closed-loop temperature control of the engine parts is accomplished by the working fluid dispensed by a pressure-reducing device in fluidic communications with a relatively high-pressure source of the working fluid. Therefore, more accurate temperature control may be achieved by sensing and adjusting coolant flow to maintain optimal steady operating temperature of the engine.

BRIEF DESCRIPTION OF DRAWINGS

The non-limiting embodiments may be more fully appreciated by reference to the following detailed description of the non-limiting embodiments when taken in conjunction with the accompanying drawings, in which.

Figures 1A, 1B:
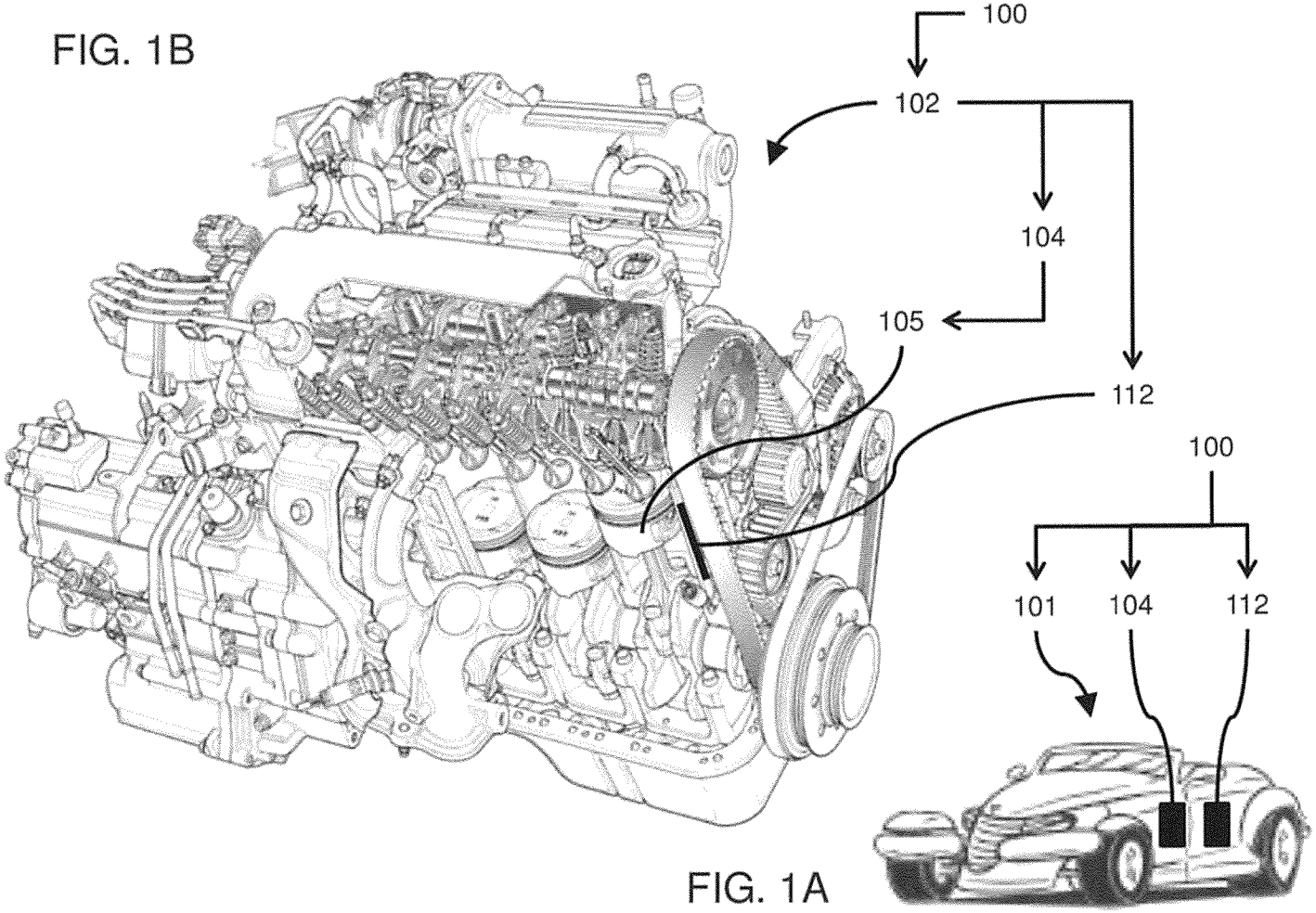
FIGS. 1A and 1B (Sheet 1) depict schematic representations of perspective views of an example of an apparatus.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

REFERENCE NUMERALS

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. In addition, common, but well-understood, elements that are useful or necessary in commercially feasible embodiment are often not depicted in order to facilitate a less obstructed view of these various embodiments of the present disclosure.

100 apparatus
101 movable vehicle
102 engine
104 heat-generating assembly
105 piston assembly
108 connecting passageway
112 cooling system
116 cooling medium
117 pressure-reducing device
118 temperature sensor
122 pressure sensor
124 spray-generating device
125 intake assembly
127 heat-exchange structure
128 outlet assembly
129 circuit assembly
199 combustion chamber
200 energy-management system
201 circuit assembly
202 connection passageway
218 engine body
230 engine exhaust manifold
232 connection passageway
234 connection passageway
236 connection passageway
300 thermodynamic cycle
301 first compressor assembly
302 intercooler
303 second compressor assembly
304 heat exchanger
305 pressure-reducing gas expander
306 gas cooler
307 heat exchanger
308 fluid distribution connector
309 pressure-reducing device
311 low-pressure connector
312 gas-liquid separator
313 pressure-reducing device
314 heat exchanger
315 working-fluid connection
316 exhaust port
330 cabin-cooling loop
331 pressure-reducing device
332 heat exchanger
334 heat exchanger
340 cooling loop
360 fluid line
361 conduit
362 conduit
363 conduit
364 conduit
365 line
366 conduit
367 line
370 rotating shaft
371 electric generator
372 mechanical flywheel
373 compressor
374 energy-converting device
376 hot exhaust air flow
380 liquid state
381 working fluid
390 bypass valve
391 control system
392 pressure-reducing device
393 circulating medium

400 energy-recovery system
401 circuit assembly

DETAILED DESCRIPTION OF NON-LIMITING EXEMPLARY EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples), aspects and/or concepts defined in the appended claims. Hence, specific dimensions and other physical characteristics relating to the embodiments disclosed herein are not to be considered as limiting, unless the claims expressly state otherwise.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The terms "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

Referring to FIGS. 1A and 1B (Sheet 1), there is depicted the schematic representations of perspective views of the example of an apparatus 100.

According to an option, the apparatus 100 includes an engine 102 of a movable vehicle 101. By way of example, the engine 102 includes (and is not limited to) an internal-combustion engine. The engine 102 includes a combination of a heat-generating assembly 104, and a cooling system 112. An example of the heat-generating assembly 104 includes a piston assembly 105 operatively mounted in the engine 102; specifically, the piston assembly 105 is operatively mounted to an engine body 218 (depicted in FIG. 2 and also called an engine block) of the engine 102. The cooling system 112 is configured to circulate a cooling medium 116 relative to the heat-generating assembly 104. The cooling medium 116 has carbon dioxide (in the liquid form and/or in the gas form). This is done in such a way that the carbon dioxide of the cooling medium 116 conveys heat from the heat-generating assembly 104 to the cooling medium 116. The cooling medium 116 transports the heat away from the heat-generating assembly 104.

An advantageous nature of carbon dioxide is that it is nonflammable and/or a good electrical insulator. Carbon dioxide is heavier than air and thus may also provide another advantage. In addition, the use of carbon dioxide as the cooling medium 116 may provide a lower negative impact to the environment (in comparison to toxic refrigerants that are not environmentally friendly). Due to the high volumetric capacity of carbon dioxide, which is five times higher than water, the size of the cooling system 112 may be reduced considerably by having carbon dioxide included in the cooling medium 116. The increased working pressure may allow for structural and/or dimensional reduction thus directly benefiting objectives of reduced size and/or weight when applied to vehicular applications. A further advantage of using carbon dioxide in the cooling medium 116 is further emphasized by a significant increase in heat capacity when close to critical temperature. The critical temperature may be optimized by mixing carbon dioxide with neon and/or butane or other elements (if so desired) to optimize the heat-absorption temperature point. Carbon dioxide (and any equivalent thereof) is used for the cooling of the heat-generating assembly 104. As an option, the carbon dioxide may also be used for heat recovery by an expender assembly for generating power (recovery of energy) in a closed-loop trans-critical vapor compression cycle. In the preferred embodiment, carbon dioxide (and any equivalent thereof) is included in the cooling medium 116 for the trans-critical cooling and heat recovery application. For example, an equivalent of carbon dioxide may include a suitably developed synthetic working fluid (cooling medium 116) and/or nano-fluid based solutions used to cool the heat-generating assembly 104.

According to another option (a more specific option), the engine 102 of the movable vehicle 101 includes the combination of the heat-generating assembly 104 and the cooling system 112. The heat-generating assembly 104 is configured to generate heat once actuated to do just so. An example of the heat-generating assembly 104 includes a piston assembly 105 and any equivalent thereof. The cooling system 112 is configured to be positioned relative to the heat-generating assembly 104. The cooling system 112 is further configured to have the cooling medium 116 including, at least in part, carbon dioxide (in the liquid form and/or in gas form). The cooling system 112 is further configured to circulate, at least in part, the carbon dioxide relative to the heat-generating assembly 104. The circulation is done in such a way that the carbon dioxide conveys, at least in part, heat from the heat-generating assembly 104 to the cooling medium 116 as the carbon dioxide is circulated, in use, by the cooling system 112.

According to another option, the apparatus 100 includes the cooling system 112 separate or apart from the engine 102 of the movable vehicle 101. In other words, the cooling system 112 is manufactured by one entity and is then provided to another entity that manufactures the engine 102 and deploys the cooling system 112 into the engine 102. The cooling system 112 is configured to be positioned proximate to the heat-generating assembly 104 of the engine 102. The cooling system 112 is further configured to circulate the cooling medium 116 having the carbon dioxide (in the liquid form and/or in gas form) relative to the heat-generating assembly 104. The circulation is done in such a way that the carbon dioxide conveys heat from the heat-generating assembly 104 to the cooling medium 116. The cooling medium 116 transports, in use, the heat away from the heat-generating assembly 104.

According to another option, the apparatus 100 is for the heat-generating assembly 104 of the engine 102 of the movable vehicle 101. The apparatus 100 includes a frame assembly configured to be positioned proximate to the heat-generating assembly 104 of the engine 102. Furthermore, the cooling system 112 is supported by the frame assembly. The cooling system 112 is also configured to circulate a cooling medium 116 having the carbon dioxide (liquid and/or gas) relative to the heat-generating assembly 104. The circulation is done in such a way that the carbon dioxide conveys heat from the heat-generating assembly 104 to the cooling medium 116. The cooling medium 116 transports the heat away from the heat-generating assembly 104. The cooling medium 116 may be cooled, and/or the cooling medium 116 may be recompressed and cooled, for subsequent use.

According to another option, there is provided the apparatus 100 in which the apparatus 100 includes a movable vehicle 101 that includes the engine 102. For this option, the movable vehicle 101 may include an electric vehicle having an electric drive that may use a battery assembly, or may use a collection of hydrogen cells, etc. For this case, the engine 102 includes an electric motor assembly and/or an electric motor assembly in combination with an electric battery assembly. The movable vehicle 101 includes the combination of the heat-generating assembly 104 and the cooling system 112. The cooling system 112 is configured to circulate the cooling medium 116 having carbon dioxide (liquid form and/or gas form) relative to the heat-generating assembly 104. In this way, the carbon dioxide conveys heat from the heat-generating assembly 104 to the cooling medium 116. The cooling medium 116 transports the heat away from the heat-generating assembly 104.

According to another option, there is provided a method, including (the step of) providing the cooling system 112 configured to circulate the cooling medium 116 having the carbon dioxide (in a liquid state and/or in a gas state) relative to the heat-generating assembly 104 of the movable vehicle 101. For this option, the movable vehicle 101 may include an electric drive that may use a battery assembly, or may use a collection of hydrogen cells, etc. This is done in such a way that the carbon dioxide conveys heat from the heat-generating assembly 104 to the cooling medium 116, and the cooling medium 116 transports the heat away from the heat-generating assembly 104.

The following identifies some examples of the movable vehicle 101: a gasoline hybrid vehicle (HEV), which contains a battery assembly, an instance of the engine 102, and an electric drive (with solid-state controllers). The cooling system 112 may be deployed in the gasoline hybrid (HEVs) vehicle so that at least some of the components of the gasoline hybrid (HEVs) vehicle may be cooled (or heated) to maintain efficient operation. The cooling system 112 uses the cooling medium 116 to capture heat where generated, and to move the captured heat away from the assembly that generated the heat. The plug-in hybrid vehicle (PHEVs) may include the cooling system 112. Battery electric vehicle (BEV) may also include the cooling system 112 as well. The fuel-cell vehicle (FCV) may include the cooling system 112 since the fuel-cell vehicle generates the substantial amount of heat when converting chemical energy into electricity, and therefore, the fuel-cell vehicle includes the cooling system 112 as well. The movable vehicle 101 may include a marine water craft, any type of aircraft, etc. For the above instances of the movable vehicle 101, each includes the engine 102 in some structure or form or another. As depicted in FIG. 1A (by way of example), the engine 102 includes (and is not limited to) an internal-combustion engine.

Figure 2:
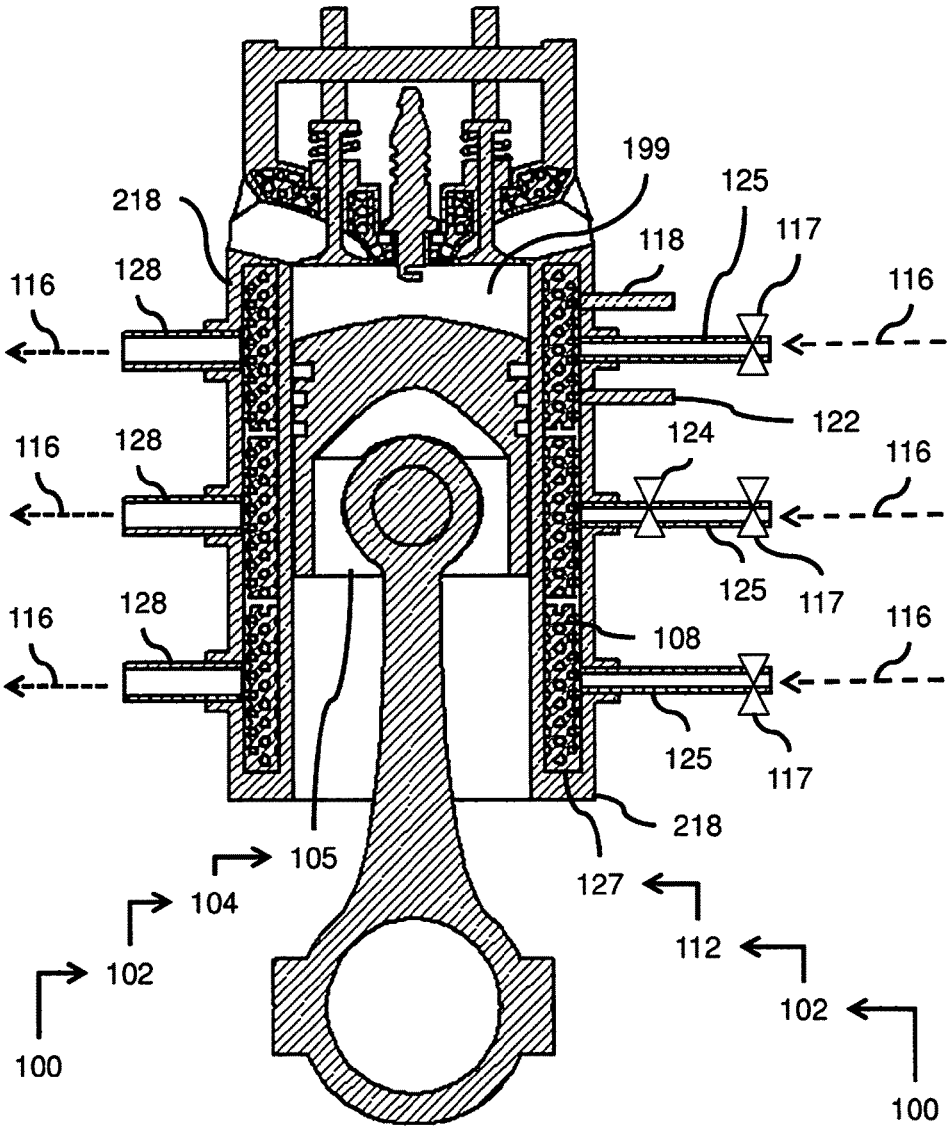
FIG. 2 (Sheet 2) depicts a schematic representation of a cross-sectional side view of an example of the apparatus of FIG. 1A and/or of FIG. 1B.

Referring to FIG. 2 (Sheet 2), there is depicted a schematic representation of a cross-sectional side view of an example of the apparatus 100 of FIGS. 1A and/or 1B. More specifically, FIG. 2 depicts an example of a piston assembly 105 (and any equivalent thereof) of the engine 102 (and any equivalent thereof). Specifically, the piston assembly 105 is an example of the heat-generating assembly 104. It will be appreciated that the cooling system 112 may be configured to cooperate with any other example of the heat-generating assembly 104, such as any other component and/or assembly associated with the engine 102 in which it is required to remove excess heat from the heat-generating assembly 104.

By way of example, the apparatus 100 may include (and is not limited to) at least one or more instances of the piston assembly 105. An engine body 218 (also called an engine block) of the engine 102 defines an instance of a cylinder. The cylinder is configured to slidably receive and to accommodate linear reciprocal sliding movement of the piston assembly 105 along a length of the cylinder defined by the engine body 218.

By way of example, the apparatus 100 includes a temperature-control structure configured to monitor and to control the temperature of the engine 102.

According to a preferred option, each instance of the cylinder (defined by the engine body 218) is associated with a respective instance of the cooling system 112. Specifically, each instance of the cooling system 112 is positioned proximate to a respective instance of the piston cylinder defined by the engine body 218 in such a way that the cooling system 112 removes excess heat from a respective cylinder once actuated to do just so.

According to an option, the cooling system 112 is configured to operatively (suitably) contain or include a connecting passageway 108 (at least one or more instances thereof). The connecting passageway 108 may include (a volume of) relatively highly heat conductive instances of the connecting passageway 108. Instances of the connecting passageway 108 are arranged to facilitate the relatively free flow of the cooling medium 116 (also called a working fluid). The cooling medium 116 may be limited only by an operating pressure associated with and controlled by a control system 391 (operating in a closed-loop fashion). The control system 391 is configured to control the pressure of the cooling medium 116 contained in the cooling system 112.

According to an option, the cooling system 112 may include a sleeve structure configured to be positioned proximate to, at least in part, an instance of the heat-generating assembly 104; more specifically, the sleeve structure is configured to be (slidably) received in an instance of the cylinder defined by the engine body 218 in such a way that the sleeve structure surrounds, at least in part, the piston assembly 105. The essential principle will be explained on this particular example, and it will be understood that the concept may be applied to the cooling of other parts or assemblies or components of the engine 102, or of the movable vehicle 101 in which the engine 102 is operatively mounted therein.

The cooling system 112 is configured to provide fluid channels that are preferably arranged to conformally surround (at least in part) the volume of the cylinder (or any example of the heat-generating assembly 104). The cooling system 112 is configured to be in relatively close thermal communication with the piston assembly 105 (or any example of the heat-generating assembly 104). The cooling system 112 is configured to be in relatively close thermal communication with a working envelope of the piston assembly 105 in such a way that the cooling medium 116 is in operative thermal communication so as to remove heat generated in a combustion chamber 199 of the cylinder of the engine 102. The combustion chamber 199 may be called a piston heat expanding volume or a piston head volume.

By way of example, the cooling system 112 includes an instance of the sleeve structure to be operatively received (at least in part) by the cylinder defined by the engine body 218.

An example of the sleeve structure is provided by the heat-exchange structure 127. The sleeve structure is configured to operatively (safely) receive (to support and to contain) the cooling system 112 in such a way that the cooling medium 116 is operatively constrained at a desired pressure. By way of example, the cooling medium 116 may be operated at a pressure up to about 3000 PSI (pounds per square inch) if so desired.

In accordance with an option, the cooling system 112 includes a heat-exchange structure 127 positioned in the cooling system 112. The heat-exchange structure 127 is preferably constructed from a (highly) thermally conductive material. The heat-exchange structure 127 is configured to enable relatively faster absorption of heat generated by the heat-generating assembly 104 of the engine 102. The heat-exchange structure 127 is configured to remove heat from the heat-generating assembly 104 of the engine 102 (such as the piston assembly 105). It will be appreciated that various arrangements of fluid channels of the heat-exchange structure 127 are possible; such examples include conformal tubing, micro tubing, macro tubing, channels casted in place to a purposefully devised sleeve or an insert, and/or may be made externally with suitable fluid channels and/or instance of the connecting passageway 108. The heat-exchange structure 127 is configured to increase contact surface between the heat-generating assembly 104 and the cooling system 112 having the cooling medium 116. Instances of the sleeve (also known as a cylinder structured insert or an insert) may be assembled in a casting mold and over casted during the engine casting process. After casting, inner surfaces are machined to tolerances required for high-efficiency constant temperature accurately controlled sliding surfaces. The cylinder sleeves may be made from various materials such as aluminum and its alloys, a copper alloy or a steel alloy or a diamond matrix, all with high thermal conductivity, and also including composite materials with specific properties of high thermal conductivity such as graphite or carbon nano-tubes derivatives (for example). The cylinder sleeves are configured to interface to an instance of an intake assembly 125. The intake assembly 125 may be called an intake fluid line connection. The intake assembly 125 is configured to deliver the cooling medium 116 to the sleeve. The heat-exchange structure 127 may include the sleeve or may be the sleeve.

Generally speaking the cooling system 112 includes the intake assembly 125 operatively mounted to the connecting passageway 108. The intake assembly 125 may also be called an intake fluid line. The cooling system 112 also includes an outlet assembly 128 that is spaced apart from the intake assembly 125. The outlet assembly 128 is operatively mounted to the connecting passageway 108. The outlet assembly 128 may also be called an exhaust fluid conduit or an exhaust. The cooling system 112 includes a temperature sensor 118 operatively mounted to the body that defines the connecting passageway 108. The temperature sensor 118 is configured to sense (indirectly or directly) the temperature of the cooling medium 116 flowing through the connecting passageway 108. At least one instance of the intake assembly 125 and at least one instance of the outlet assembly 128 are provided in such a way that the cooling medium 116 is delivered to the connecting passageway 108 and is removed from the connecting passageway 108.

The cooling system 112 includes a pressurized source configured to deliver the cooling medium 116 in a liquid state (may be a liquid state and/or a gas state). The cooling system 112 includes a pressure-reducing device 117 operatively positioned at the intake assembly 125. The pressure-reducing device 117 is configured to reduce (drop) the pressure of the cooling medium 116 in such a way as to enable evaporation of the cooling medium 116 to begin inside the connecting passageway 108 of the cooling system 112, so that the cooling medium 116 may flow, in use, inside the cooling system 112.

The cooling system 112 includes (or is filed with) instances of the connecting passageway 108 configured to facilitate the flow of the cooling medium 116 inside the heat-exchange structure 127 that surrounds the heat-generating assembly 104. The heat-exchange structure 127 encompasses, at least in part, the combustion chamber 199. The heat-exchange structure 127 may be an insert structure configured to be received, at least in part, by the heat-generating assembly 104, and/or to be positioned proximate to the heat-generating assembly 104. As well, the heat-exchange structure 127 may be an integral component of the heat-generating assembly 104 if so desired.

After completely or partially evaporating at the outlet assembly 128 and exiting the cooling system 112 via the outlet assembly 128, the cooling medium 116 may be in the form of an exit vapor and/or a cooling vapor. The one or more instances of the outlet assembly 128 may be dimensionally larger than the dimension of the intake assembly 125 (the fluid supply opening) in such a way as to allow for the expanded instance of the cooling medium 116 for a predetermined minimum pressure suitable to maintain the cooling medium 116 in a preferably closed-loop state and/or at a closed-loop pressure control. It will be appreciated that not all of the cooling medium 116 may fully evaporate, and a mixture of some amount of a liquid portion and some amount of a gas portion of the cooling medium 116 may be expected at the outlet assembly 128.

Figure 4A:
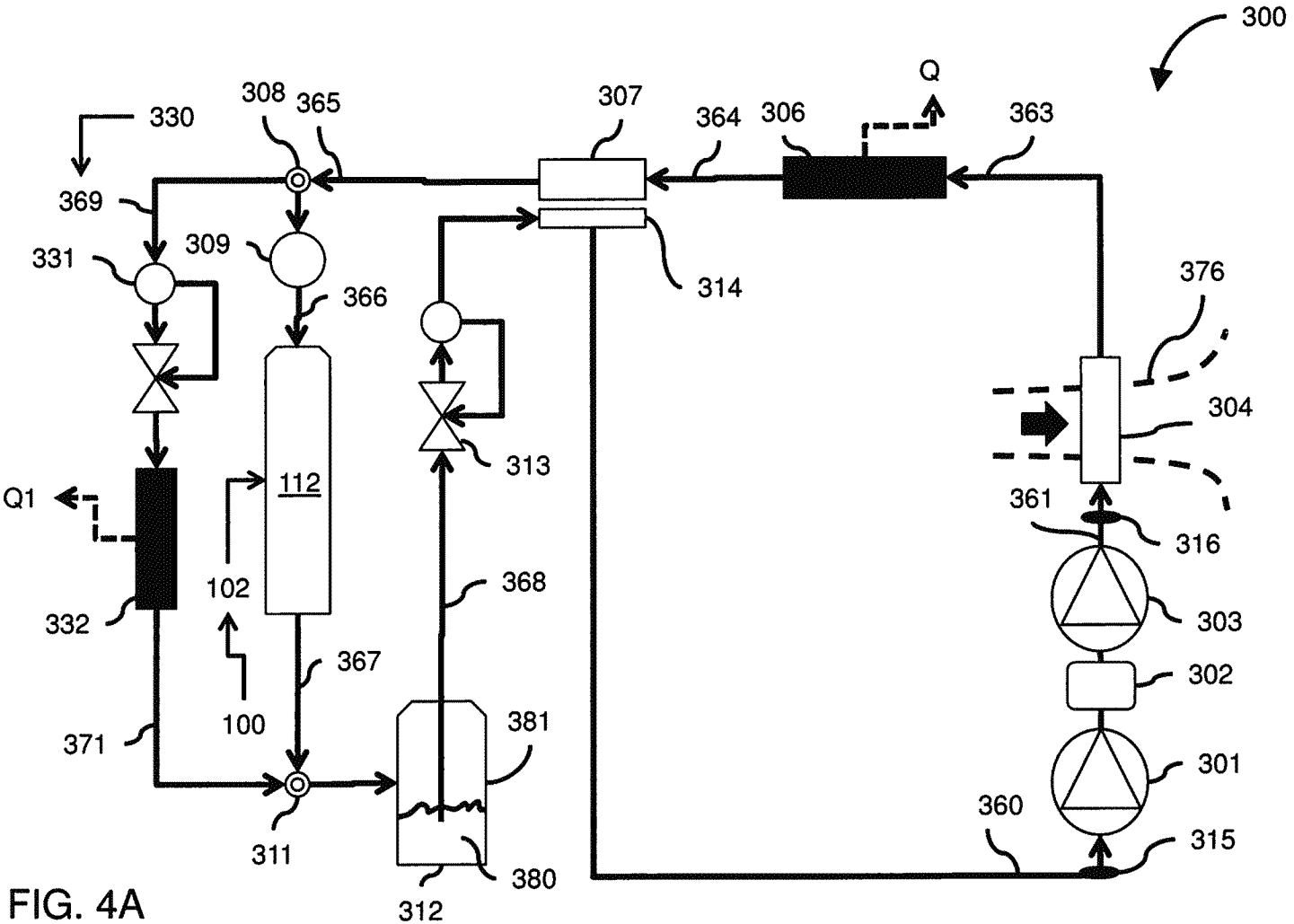
FIGS. 4A and 4B (Sheet 4 and Sheet 5, respectively) depict schematic representations of examples of the apparatus 100 of FIG. 1A and/or of FIG. 1B.
Figure 4B:
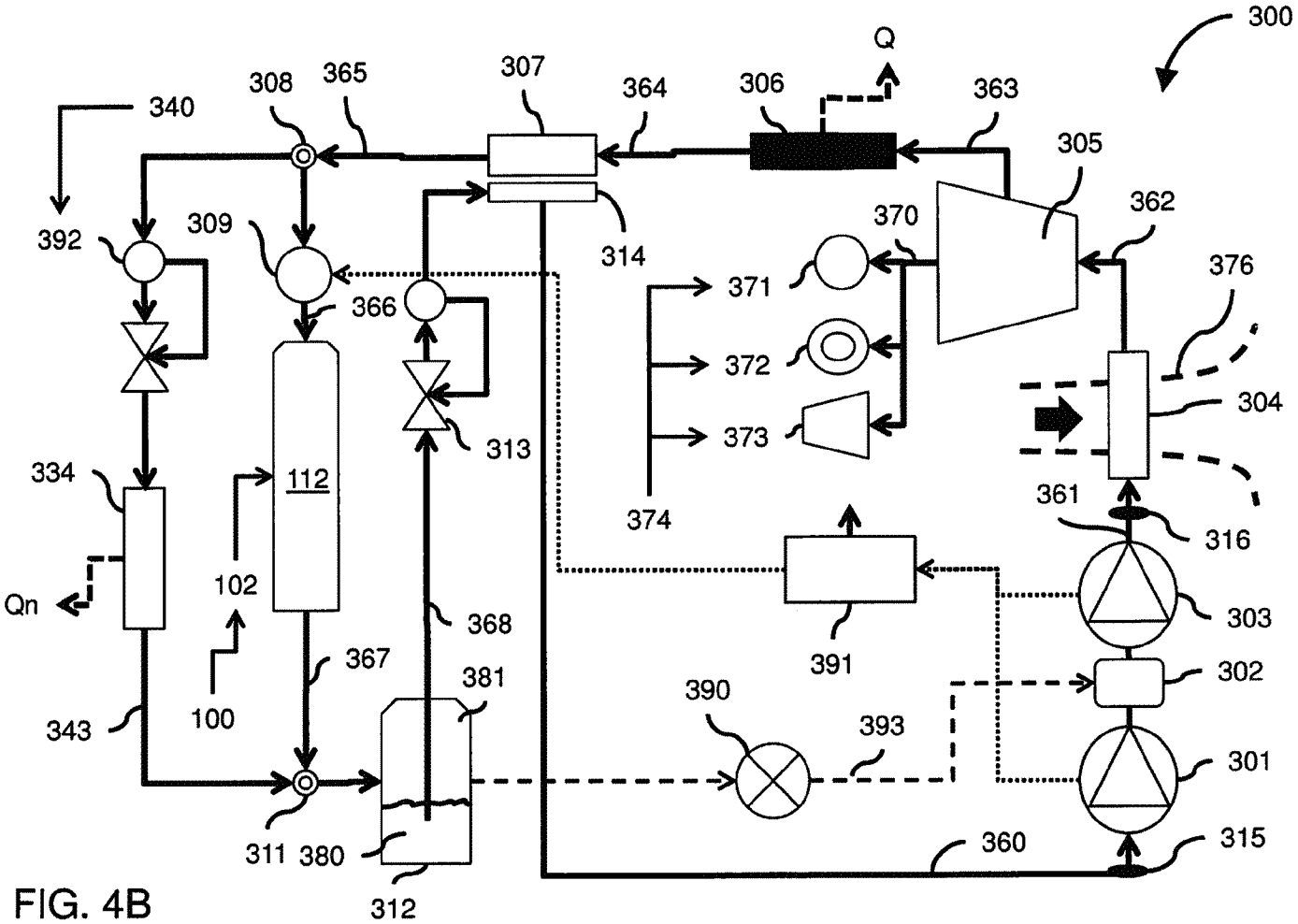

Referring now to FIGS. 4A and 4B, for the case where the cooling medium 116 includes a mixture (of a liquid portion and a gas portion), the outlet assembly 128 of the cooling system 112 includes (is connected to) a gas-liquid separator 312 configured to separate the components of the mixture in such a way so as to ensure safe operation of a gas compressor (not depicted). The gas-liquid separator 312 may be configured to provide storage of an additional spare amount of the cooling medium 116. The gas-liquid separator 312 may be configured to initially fill the cooling medium 116 and/or for re-charging the cooling medium 116 to make up for potential leaks of the cooling medium 116 from the cooling system 112.

Turning to FIG. 2, it will be appreciated that FIG. 2 depicts an exemplary view of the cooling system 112 configured to cool (and/or to heat) at least one instance of the piston assembly 105 (or any example of the heat-generating assembly 104). This example is in no way limiting in the applicability to remove heat from that area and/or perhaps even deliver heat to a predetermined area or zone at a start-up of the engine 102 (if so desired). It will be appreciated that the cooling system 112 may be called a thermal-management system, a heat-management system, etc.

In accordance with an option, the cooling system 112 includes a spray-generating device 124 configured to increase the rate of heat energy absorption. The spray-generating device 124 is located at suitable location proximate to a margin of the connecting passageway 108. The spray-generating device 124 is configured to be operatively attached to the cooling system 112 and/or to the intake assembly 125.

It will be appreciated that the principles described above are applicable to any portion, parts assemblies or payload of the movable vehicle 101 (the mobile cooling application). Therefore, cooling of the oil used to lubricate the instances of the piston assembly 105 is another application of the cooling system 112. Another example of deployment of the cooling system 112 is using the cooling system 112 to cool (generally, to manage thermal energy of) an engine exhaust manifold 230 (FIG. 3) by a separate circulating instance of the cooling medium 116 made to pass by the outlet assembly 128 of the engine 102. As well, combining the gathered heat energy (collected by the cooling system 112) with other sources of heat energy in the cooling medium 116 allows for a portion of heat energy losses to be recovered during recompression and expansion of the cooling medium 116 in a thermodynamic cycle 300 depicted in FIGS. 4A and 4B. The thermodynamic cycle 300 may be called a trans-critical carbon dioxide thermodynamic cycle or called a closed continuous thermodynamic cycle.

Optionally, the cooling medium 116 may be used, at least in part, in a process to convert or to recover the heat into usable energy in a high-efficiency expander. For example, the pressure-reducing gas expander 305 (of FIGS. 4A and 4B) may provide a speed regulated positive displacement device, digitally controlled liquid ring positive displacement devices and/or known devices engineered for efficient operation.

Figure 3:
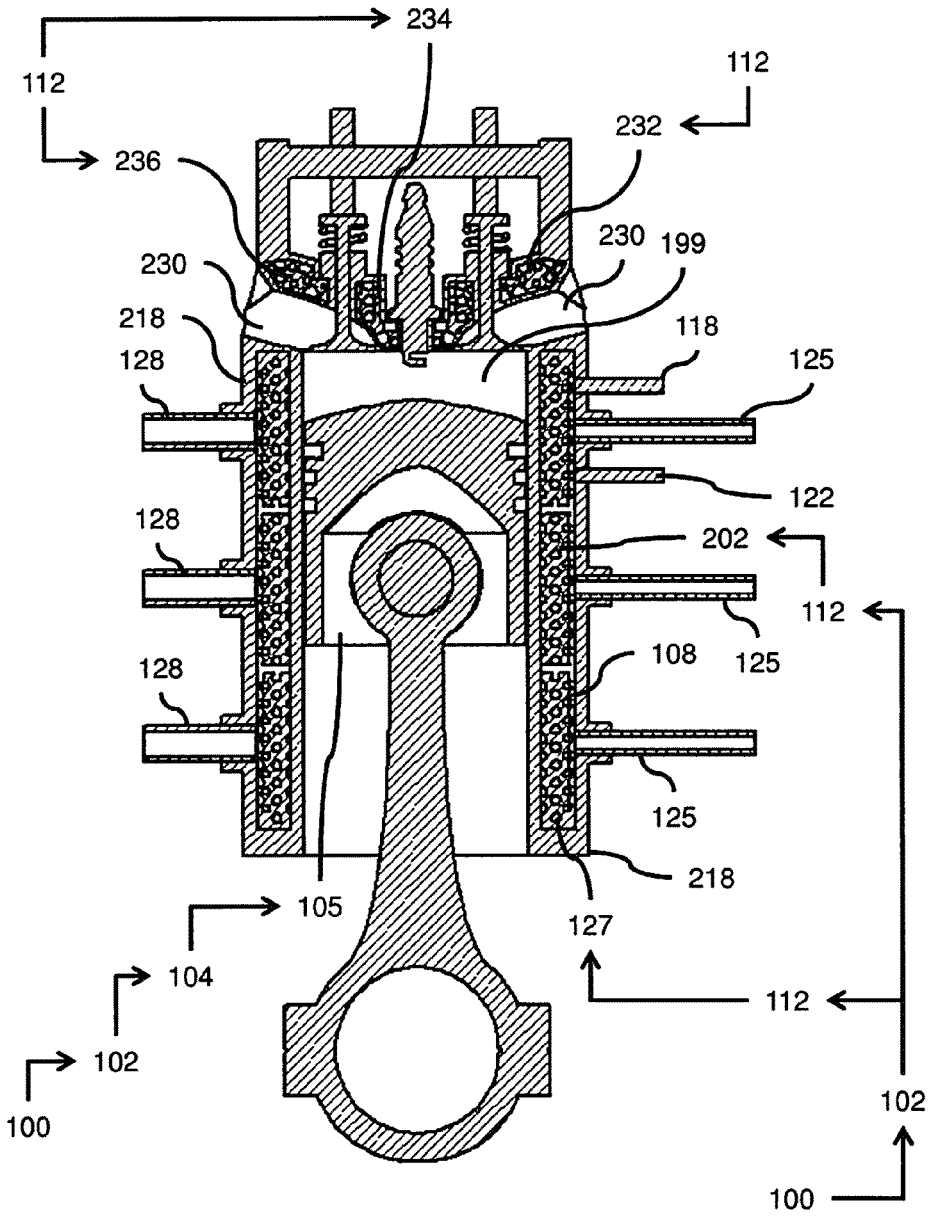
FIG. 3 (Sheet 3) depicts a schematic representation of a cross-sectional side view of an example of the apparatus 100 of FIG. 1A and/or of FIG. 1B.

Referring to FIG. 3 (Sheet 3), there is depicted a schematic representation of a cross-sectional side view of an example of the apparatus 100 of FIGS. 1A and/or 1B. More specifically, FIG. 3 depicts multiple controlled cooling zones incorporating (each having a respective instance of) a connection passageway 232, a connection passageway 234, a connection passageway 236, and the connecting passageway 108, and the intake assembly 125 and the outlet assembly 128 handles the cooling medium 116. Connection of the intake assembly 125 and the outlet assembly 128 of the cooling medium 116 to the connection passageway 232, to the connection passageway 234, and to the connection passageway 236 are not explicitly depicted but are implicitly provided (FIG. 3 was simplified for the sake of improved clarity).

Each controlled temperature zone is in communication with a thermal load of the heat-generating assembly 104, and is in operative communication with a proportional controller. The proportional controller is in electrical communication with the pressure-reducing device 117 configured to control the flow of the cooling medium 116 through the instances of the connection passageway 232, the connection passageway 234, the connection passageway 236 and the connecting passageway 108. The pressure-reducing device 117 is configured to modulate the amount of the cooling medium 116 at the intake assembly 125 (see FIG. 2). At the outlet assembly 128 (see FIG. 2), the larger volume of the gas vapor mixture may be expected.

Referring back to FIG. 2, the cooling medium 116 (preferably having the carbon dioxide in the liquid state) is metered by the pressure-reducing device 117 into the expansion space of the heat-exchange structure 127. The connecting passageway 108 includes a combination of liquid passages, and exhausts the expansion volume with the pressure slightly below the critical pressure of the carbon dioxide in such a way as to ensure that cooling of the heat-generating assembly 104 is accomplished in a trans-critical carbon dioxide vapor compression cycle. Carbon dioxide has the critical temperature of 30.9 degrees Centigrade (C). The meaning of sub-critical at absorption is a sub-critical process and works at low pressure and temperature in an evaporator assembly, in this case the engine 102, with fluid channels surrounding the heat-generating assembly 104.

Referring to FIGS. 4A and 4B, the heat rejection or heat energy recovery occurs after gas pressurization in a first compressor assembly 301, and if required, in a second compressor assembly 303, and increases of the gas pressure is a super critical process and occurs above the critical temperature of the cooling medium 116, preferably in a pressure range from about 1,400 to about 2,500 PSI.

The heat rejection in the supercritical region of the trans-critical process occurs by sensible cooling of the cooling medium 116 at a constant pressure in a gas cooler 306. The gas cooler 306 may be engineered to have an instance of the heat-exchange structure 127 with instances of the connecting passageway 108 suitably placed in a form of a skin panel (outer surface area of the movable vehicle 101) used for cooling as a secondary function (and possibly improving crash worthiness of the movable vehicle 101 if so configured to do just so). The connecting passageway 108 may include a micro channel assembly. Since a large portion of the heat energy captured may be recovered in a (regenerative) thermodynamic cycle 300 (see FIGS. 4A and 4B) and minimal energy may need to be dissipated into environment. So, potentially powered fans may not be required because the large surface area panels may be able to dissipate heat by surface area and by limited forced-air circulation moving past the gas cooler 306 as an air stream moves past the movable vehicle 101. An outer panel assembly of the movable vehicle 101 may be positioned to take the air stream focused by aerodynamic surfaces in such a way so as to direct air flow into and through the micro channels thereby removing heated air at an air exhaust point. Micro-channels are configured to conduct the cooling medium 116. A relatively large surface area may facilitate effective (improved) heat removal while structural integrity of the area may be improved. Installation of the suitable filter at the cooling air intake may be an option. The trans-critical vapor compression cooling process is well-known in the art and is not further described here.

Referring to FIG. 2, the cooling system 112 is configured to contain the connecting passageway 108, among (within) the heat-exchange structure 127. The cooling system 112 is configured to facilitate movement or flow of the cooling medium 116 around the heat-generating assembly 104.

FIG. 2 depicts an example of the cooling system 112. The heat-exchange structure 127 of the cooling system 112 may include or contain a porous structure with the connecting passageway 108 surrounding the heat-generating assembly 104 of the engine 102. The cooling system 112 may include aluminum, steel and/or composites. The cooling system 112 may have an open porous structure (foam) with porosity up to about 90% with open and continuous pore structure in nominal size from about 50 to about 500 micrometers. Aluminum foam may be additive or in situ developed during a casting process. In one form, the heat-exchange structure 127 is made by sintering powders and closing outside margins of the expansion chambers with low temperature alloys. The cylinder face can be made from steel with the cooling system 112 and the intake assembly 125 and the outlet assembly 128. This may also be made during the post casting process by threaded connections and micro tubing. Each controllable cooling zone may be equipped with at least one instance of the temperature sensor 118 and of the pressure sensor 122. Each close loop control of temperature may be based upon the reference values from the temperature sensor 118 and the pressure sensor 122 for use by the control system 391 (see FIG. 4B). The pressure-reducing device 117 and/or the spray-generating device 124 may be provided so that accurate mass flow control of the cooling medium 116 may be maintained for accurate zone temperature controls.

Referring to FIGS. 4A and 4B (Sheets 4 and 5), there is depicted a schematic representation of examples of the apparatus 100 of FIGS. 1A and/or 1B. More specifically, there is depicted a schematic diagram of the exemplary embodiment of the cooling system 112 usable by the movable vehicle 101.

The cooling system 112 may operate in the thermodynamic cycle 300 of FIGS. 4A and 4B.

The cooling system 112 includes a first compressor assembly 301, a second compressor assembly 303, and an intercooler 302. The heat from the intercooler 302 can be used for heating the passenger cabin of the movable vehicle 101 because heat is available immediately after powering the movable vehicle 101. The first compressor assembly 301 is coupled (indirectly) to the cooling system 112. The intercooler 302 is coupled to the first compressor assembly 301. The intercooler 302 is coupled to the second compressor assembly 303. The intercooler 302 may, in some arrangements, exchange heat energy with environment if desired.

A heat exchanger 304 is configured to absorb heat from the engine exhaust manifold 230 (depicted in FIG. 3) from the engine 102. The heat exchanger 304 is coupled to the second compressor assembly 303.

According to an option, the apparatus 100 also includes a pressure-reducing gas expander 305, a gas cooler 306, a heat exchanger 307, a pressure-reducing device 309, a gas-liquid separator 312 (also called a working-fluid accumulator). The gas cooler 306 is coupled to the heat exchanger 304. The heat exchanger 307 is coupled with the gas cooler 306. The pressure-reducing device 309 is coupled to the heat exchanger 307. The cooling system 112 is coupled to the pressure-reducing device 309. The cooling system 112 is coupled to the gas-liquid separator 312. The heat exchanger 307 is positioned proximate to the heat exchanger 314.

A reason for using latent heat in the remaining liquid coolant in 314 and absorb heat from heat exchanger 307 is for improved cooling of the cooling medium in the line 365, as well as the need to evaporate accumulated liquid before the liquid arrives at the intake of the compressor 373.

The gas-liquid separator 312 is connected back via the heat exchanger 314 to an intake side 315 of the first compressor assembly 301.

According to an option, a cabin-cooling loop 330 and a cooling loop 340 may be used for absorbing heat from the cabin of the movable vehicle 101. Alternatively, a cooling loop is used to absorb heat from the engine exhaust gas at the heat exchanger 334. These additional cooling loops may be connected at the (relatively higher pressure) fluid distribution connector 308 and a low-pressure connector 311 for the returning the cooling medium 116 enriched by the heat energy. Similarly, additional cooling loops may include a pressure-reducing device 331, a pressure-reducing device 392, a heat exchanger 332, and a heat exchanger 334.

Referring to FIGS. 4A and 4B, the first compressor assembly 301 includes (for example) a two-stage compressor with the working-fluid connection 315 connected to the first input side stage of the first compressor assembly 301. The cooling medium 116 in the gaseous state is compressed with a high compressor ratio preferably in the positive displacement piston compressors and then with fluid communication to second stage compressor transfer to the input of the second compressor assembly 303. The second compressor assembly 303 preferably compresses the cooling medium 116 further to a high-pressure range above critical pressure for the carbon dioxide and preferably up to 2000 PSI (pounds-per-square-inch) determined by the efficiency factors in the thermodynamic process for the trans-critical operation. It is possible to achieve pressure ratios even with single compressor stage in the most preferred option. It may be required to cool compressed fluid after first stage of the compression, and the heat extracted by the intercooler 302 can be used to provide heat to the passenger compartment (cabin) or other payloads of the movable vehicle 101 (in a moving applications).

In another alternative embodiment, the heat exchanger 304 can be used without second compressor assembly 303 to attain high-pressure supercritical state of the cooling medium 116 by absorbing heat from the exhaust gasses.

On power up when the engine 102 is cold, it may be advantages to heat up the engine 102 as fast as possible because a cold engine is very inefficient and pollutes the environment intensely. To facilitate initial heating, the gas fluid is pushed in a bypass mode to heat up the components of the engine 102. This is done by driving the first compressor assembly 301 and/or the second compressor assembly 303 in temporary low pressure operational mode when the bypass valve is open to allow for circulating fluid to circulate and apply heat to the engine 102 and/or the passenger cabin of the movable vehicle 101. The temperature of the circulating medium 393 is above environment temperature. So, heating as well as cooling can be accomplished with approach described where both functions are under the control of the control system 391.

State of the art compressors may be used and are readily available. The scroll, rolling piston, screw, lobe, liquid ring vane or digital liquid piston compressors are preferable but other gas compressors may be used in FIGS. 4A and 4B.

In accordance with an option, the first compressor assembly 301 and the second compressor assembly 303 each include a positive-displacement variable-flow piston compressor. The piston compressor includes a digitally controlled constant stroke radial piston compressor utilizing a liquid piston gas compression principle that is disclosed in United States Patent Publication Number 2012/0023918 and further modified for liquid piston gas compression requirements. The liquid includes synthetically-derived oil, and the cooling medium 116 includes carbon dioxide in a gas state compatible with the oil. To accomplish variable displacement, the digital fast electronically controlled valves are installed at the intake assembly 125 and the outlet assembly 128 for each cylinder. The modulating and commutating of the flow of the cooling medium 116 is done in such a way that high compression efficiency is maintained at a range of flow rates of the cooling medium 116. Other compressors (such as screw, turbine and/or liquid ring compressors) may be suitably used. For the second stage, one or both instances of the first compressor assembly 301 and the second compressor assembly 303 may be variable flow compressors.

Referring to FIGS. 4A and 4B, at an exhaust port 316 of the second compressor assembly 303, the cooling medium 116 is in communication with the heat exchanger 304 via a conduit 361. The hot instance of the cooling medium 116 after compression is now passed through the heat exchanger 304 in thermal communications with hot exhaust air flow 376 arriving from the engine 102 (or from other components of the movable vehicle 101). The cooling medium 116 receives heat energy from the hot exhaust air flow 376 in such a way as to increase kinetic energy of the instance of the cooling medium 116 flowing through the heat exchanger 304 by further accumulating energy in the trans-critical stage of the cycle and combining energy from the hot exhaust air flow 376 and the energy from the engine housing, then thermo-conductively transferring energy to the cooling medium 116. The heat exchanger 304 is configured to discharge the heated instance of the cooling medium 116 via the conduit 362 to a pressure-reducing gas expander 305. The pressure-reducing gas expander 305 is, preferably, a piston digitally controlled expander or a known high-efficiency turbine expander. The pressure-reducing gas expander 305 is configured to convert the heat energy from the high-pressure supercritical gas state of the cooling medium 116 to mechanical energy of a rotating shaft 370 of the pressure-reducing gas expander 305. In accordance with an option, connected to the rotating shaft 370 of the pressure-reducing gas expander 305 is an electric generator 371. The electric generator 371 is configured for generation of electrical energy (to be used or consumed by the movable vehicle 101). In accordance with an option, the pressure-reducing gas expander 305 is configured to provide a mechanical rotating energy storage device such as a mechanical flywheel 372. In accordance with another option, the pressure-reducing gas expander 305 is configured in such a way that the rotating shaft 370 of the pressure-reducing gas expander 305 is mechanically connected to a compressor 373. The compressor 373 is configured to pump the intake air in the engine 102 and increase shaft horse power and therefore, increase efficiency of the engine 102 (if so desired). The expansion gasses of the engine exhaust drive the turbocharger and/or the supercharger that are currently driven by the engine 102 directly or powered by an electric motor, and (therefore) currently adding to the power burden of the engine 102.

It is believed that about 60% to about 70% of the energy from the fuel consumed by the engine 102 is lost in the combustion process, and only about 20% of the fuel intake energy is converted to motive power that moves the movable vehicle 101. What energy that may be recovered with the above-described improvements to the apparatus 100 may represent efficiency improvements (to some degree).

In accordance with an option, the recovered energy (recovered from the cooling medium 116) may be stored as: (A) electrical energy in an energy-storage system (such as batteries and/or super capacitors), or (B) mechanical energy in an energy-storage system (such as a flywheel and/or a compressible medium), and/or (C) chemical energy in an energy-storage system (such as hydrogen gas generated, contained and managed by suitable structures).

Referring to FIGS. 4A and 4B, the expanded instance of the cooling medium 116 is passed via a conduit 363, into an intake port of a gas cooler 306 (also analogically called a condenser). Suitable arrangement is made to dissipate and to cool the cooling medium 116 (as a gas form) by blowing environmental air and removing remaining heat energy from the cooling medium 116. The gas cooler 306 can be efficiently made by using micro channel cooling passages that are similar to the one made with open pore sheet-like material. The porous material may be sandwiched or contained in a sealed gas or liquid tight vessel with intake and exhaust ports to accommodate high pressure gas flow. The gas cooler 306 can be incorporated in the vehicle body of the movable vehicle 101 as a gas cooler structure of an outer panel of the movable vehicle 101, or the front-wheel side panels of the movable vehicle 101 when used with the cooling medium 116. It may not be possible to use these panels with water-cooling as is done today. The panel-like coolers incorporated in the structure of the vehicle body of the movable vehicle 101 may reduce weight and improve vehicle aerodynamic coefficient of drag of the movable vehicle 101. Well known air cooled heat exchanger may be used as well to remove unrecovered energy from the cooling medium 116.

Once sufficiently cooled, the cooling medium 116 (may exist within the gas state) is condensed at the exit port of the gas cooler 306 and flows in the conduit 364 that connects the gas cooler 306 to a heat exchanger 307. The heat exchanger 307 is configured to superheat the cooling medium 116 to ensure that only gas vapor show up at a working-fluid connection 315 of the first compressor assembly 301, but as well supercool the cold gas below supercritical temperature and convert the cold gas to a liquid form or liquid state.

From the exit port of the heat exchanger 307, the cooling medium 116 is in fluidic communication with a pressure-reducing device 309. The pressure-reducing device 309 is configured to reduce pressure without temperature change and convert pressurized liquid form of the cooling medium 116 into an expending gas instance of the cooling medium 116 that will now absorb heat provided by the engine 102. The pressure-reducing device 309 may be computer controlled or self-controlled based on thermostatic feedback. However, the pressure-reducing device 309 can include an expansion turbine or an electronically controlled injector valve configured to optimize the flow of the cooling medium 116 to the cooling system 112. The pressure-reducing device 309 may include a piston expander configured to convert the high pressure gas liquid mixture into an energy, to recover a portion of the potential energy of the cooling medium 116, and to convert the cooling medium 116 back into a more usable form of energy by reducing pressure of the cooling medium 116 with minimal change in temperature. The pressure-reducing device 309 may be connected, for example, to the rotating shaft 370 of the pressure-reducing gas expander 305 in a suitable manner (not depicted) and thereby may add further thermal (heat) energy recovery by generating additional energy. The pressure-reducing device 309 may include a gas turbine (for instance) to drop the pressure to below vapor pressure of the carbon dioxide.

The pressure-reducing device 309 is in fluidic communication with the cooling system 112 via a conduit 366, and supplies the cooling medium 116 via multiple high-pressure fluid supply means of the cooling medium 116 to the intake assembly 125 leading to heat-exchange structure 127 (depicted in FIG. 2) in thermal communication with cooling medium 116 and the heat-generating assembly 104. In a simpler way, the supply lines that supply the cooling medium 116 may be small-diameter tubing (copper or steel). Alternatively, an electrically-controlled injector valve may open or close the supply lines delivering the cooling medium 116 or advantageously modulate flow of the cooling medium 116 according to temperature control requirements for each cooling zone or particular part or volume of the engine depicted in FIG. 3 as the connection passageway 232, the connection passageway 234, and the connection passageway 236.

Once the expanded instance of the cooling medium 116 exits the heat-generating assembly 104 at the outlet assembly 128 (see FIG. 2), and the cooling medium 116 then flows, as depicted in FIGS. 4A and 4B into the gas-liquid separator 312 (also called an accumulation container). The gas-liquid separator 312 is also used as a make-up accumulator configured to separate the gas-phase component from the liquid-phase component of the cooling medium 116 in such a way as to ensure that only the gas-phase component is transmitted to a working-fluid connection 315 of the first compressor assembly 301. Furthermore, the accumulated liquid-phase component of the cooling medium 116 may be re-used by becoming fully evaporated in the pressure-reducing device 313.

From the gas-liquid separator 312, the liquid-phase component (or mixture) is further carried to the pressure-reducing device 313, and is thermostatically or preferably electronically controlled by the control system 391 (FIG. 4B) where further reduction in the pressure of the cooling medium 116 may occur in the heat exchanger 307 before the cooling medium 116 gets to the (high pressure) fluid distribution connector 308. Superheating of the cooling medium 116 in a fluid line 360 from the heat exchanger 314 insures that no liquid gets to the working-fluid connection 315. The working-fluid connection 315 may be called a gas compressor intake port. Further action to ensure that no liquid-phase component of the cooling medium 116 arrives at the intake port of the first compressor assembly 301 may be done in the first compressor assembly 301. The exit port from the heat exchanger 314 is in the fluidic communications with the intake of the first stage of the first compressor assembly 301. The cycle continually lasts for as long as the engine 102 and/or the heat-generating assembly 104 are operational.

Additional loops of the cooling medium 116 may be used for the task of gathering other sources of the heat energy from the movable vehicle 101. For instance, a cabin-cooling loop 330 configured for cooling the exhaust manifold of the engine 102. The additional loops may be added together in common with the cooling medium 116, and total heat energy is now summed up in a low-pressure connector 311. Additional loops can be used to cool other parts of the movable vehicle 101 or payloads of the movable vehicle 101.

From the forgoing, several advantages of one or more aspects provide improved cooling of the heat-generating assembly 104 of the movable vehicle 101 and/or of the heat-generating assembly 104 of the engine 102 of the movable vehicle 101 by utilizing carbon dioxide (and/or any equivalent thereof such as a nano-fluid) that allows recovery of energy in the trans-critical thermodynamic process by utilizing sensible cooling for condensation in the gas cooler 306 at pressures above critical point of the cooling medium 116. Large amount of energy that is up until now, was considered unrecoverable when water is used for cooling the engine 102 now may be efficiently recovered at least in part). Other advantages of one or more aspects are to provide the movable vehicle 101 with reduced weight and/or improved cooling and/or heating of the movable vehicle 101 in a thermodynamic process based on the natural organic refrigerant (carbon dioxide) that has fewer environmental impacts. The carbon dioxide is preferably sequestered in the movable vehicle 101 rather than exhausted in the atmosphere. Another important advantage is the in order to mitigate global heating of the earth, proposals are made to recover the carbon dioxide emitted by industry and to store the carbon dioxide deep into the ground. By deploying the captured carbon dioxide and using the carbon dioxide in the movable vehicle 101, the impact of global heating may be reduced in part. The important aspect of maintenance and repair of the movable vehicle 101 may no longer require extensive certification and full compliance with ozone depleting gases regulations and protocols (since carbon dioxide is used as (or in) the cooling medium 116).

Life on earth has been significantly compromised by usage of the halogen and fluorocarbon based (unfriendly) refrigerants. By using carbon dioxide, the unfriendly refrigerants may be reduced or eliminated, and instead use carbon dioxide (naturally readily available and relatively inexpensive) as the cooling medium 116. In addition, the use of the cooling medium 116 may enable energy recovery and energy conservation (reuse). Carbon dioxide as the cooling medium 116 is a colorless, odorless, and naturally-occurring gas. Carbon dioxide is naturally present in the atmosphere at a concentration of 350 ppm (parts per million). Carbon dioxide is essential for sustainability of plants and humans and is heavier than air, does not burn, and is therefore, safer in case of accidental release into the atmosphere. Inadvertent leaks in the cooling system 112 are less detrimental to environment. Recapturing of carbon dioxide is not mandatory as required by currently used synthetic refrigerants that are strictly regulated and use monitored.

Figure 5:
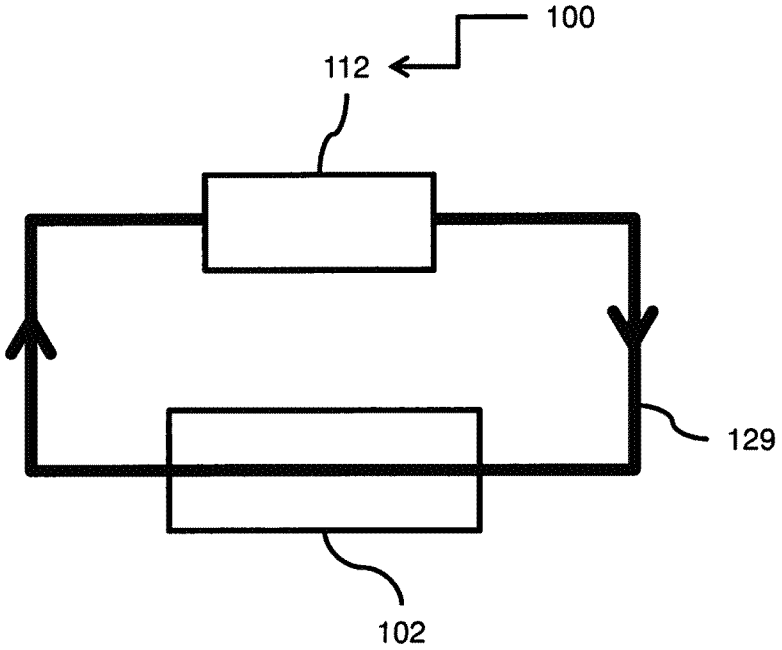
FIG. 5 (Sheet 6) depicts a schematic representation of an example of the apparatus of FIG. 1A and/or of FIG. 1B.

FIG. 5 (Sheet 6) depicts a schematic representation of an example of the apparatus of FIG. 1A and/or of FIG. 1B. In accordance with a general option, the apparatus 100 includes (and is not limited to) a combination of the engine 102 and the cooling system 112. The cooling system 112 is configured to be positioned, at least in part, relative to the engine 102. The cooling system 112 includes (for example) a circuit assembly 129 configured to pass through and/or pass proximate to and/or pass near to the engine 102. The cooling system 112 is configured to recirculate carbon dioxide relative to the engine 102. For example, the arrows positioned on the circuit assembly 129 indicate the direction of flow (recirculation or flow of recirculation) of the carbon dioxide through the cooling system 112. An example of a component used in the circuit assembly 129 is the heat-exchange structure 127 of FIG. 2A. The cooling system 112 also includes a pressurization system (a pumping system, or any equivalent thereof) configured to pump or to move the carbon dioxide through the circuit assembly 129. As well, the cooling system 112 includes a heat-removal system configured to remove heat from the carbon dioxide once the carbon dioxide passes relative to the engine 102 (as may be required). The circuit assembly 129 may be a collection of conduits, etc. The carbon dioxide may be part of a cooling medium (an energy-exchange medium or material) or may not be part of a cooling medium (as may be required). The carbon dioxide may be in the form of a gas and/or a liquid. The cooling system 112 recirculates the carbon dioxide (relative to the engine 102) in such a way that the carbon dioxide exchanges (conveys, receives) heat relative to (to and/or from) the engine 102; then the carbon dioxide transports the heat away from the engine 102 in responsive to the cooling system 112 (the pump of the cooling system 112) causing the carbon dioxide to flow (recirculate) through the circuit assembly 129).

Figure 6:
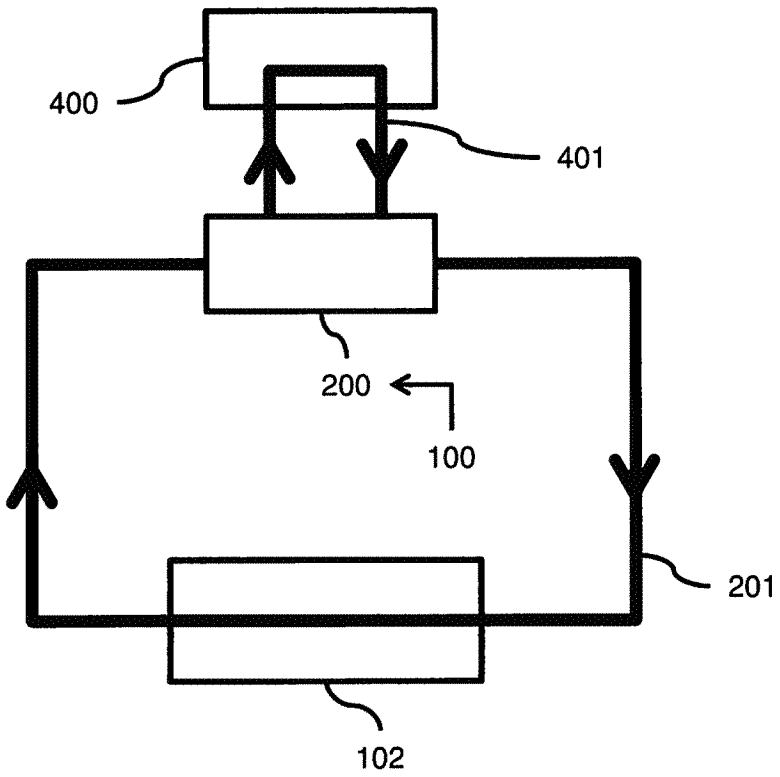
FIG. 6 (Sheet 7) depicts a schematic representation of an example of the apparatus of FIG. 1A and/or of FIG. 1B.

FIG. 6 (Sheet 7) depicts a schematic representation of an example of the apparatus of FIG. 1A and/or of FIG. 1B. In accordance with another general option, the apparatus 100 including (and not limited to) the engine 102 configured to generate energy having a first amount of the energy being usable, at least in part, for performing work. The energy also has a second amount of the energy not being useable, at least in part, to perform the work. For example, the work to be performed by the engine 102 may be used to move the vehicle of FIG. 1 or any type of movable vehicle (or stationary application for the case where the engine 102 is not required to be movable). The apparatus 100 also includes (and is not limited to) an energy-management system 200 configured to recirculate, at least in part, carbon dioxide (along with any other energy-exchange medium or material if so desired) relative to the engine 102. The energy-management system 200 recirculates (at least in part) the carbon dioxide in such a way that the carbon dioxide exchanges, at least in part, the second amount of the energy not useable to perform the work (once the carbon dioxide is made to recirculate, at least in part, along the energy-management system 200). By way of example, the energy-management system 200 includes a circuit assembly 201. The carbon dioxide flows, at least in part, through the circuit assembly 201 in response to the action (operation) of the energy-management system 200 acting to cause the carbon dioxide to recirculate (flow) through the circuit assembly 201. The circuit assembly 201 is aligned (is positioned) relative to the engine 102 in such a way that the carbon dioxide may flow through or proximate to the engine 102. The circuit assembly 201 may pass through the engine 102 or may be positioned proximate to the engine 102, etc. The engine may be used in a moving application (such as a vehicle) or in a stationary application (as may be required).

The meaning of "exchange" is broad enough to cover situations in which the carbon dioxide may receive energy (such as, thermal energy) and/or may transmit energy (such as, thermal energy) relative to the engine 102 (that is, the carbon dioxide may transmit, may receive or both may transmit and receive the energy, as may be required to suit a particular application). For the case where cooling of the engine 102 is required, the energy-management system 200 recirculates the carbon dioxide so that the carbon dioxide receives thermal energy from the engine 102 (perhaps when the engine 102 becomes overheated for example). For the case where heating of the engine 102 is required, the energy-management system 200 recirculates the carbon dioxide so that the carbon dioxide transmits the thermal energy to the engine 102 (perhaps when the engine 102 is started from a cold start on a winder day for example).

The energy-management system 200 also includes a pressurization system (a pumping system, or any equivalent thereof) configured to pump or to move the carbon dioxide through the circuit assembly 201. As well, the energy-management system 200 includes a heat-removal system configured to remove heat from the carbon dioxide once the carbon dioxide passes relative to the engine 102 via the circuit assembly 201 (as may be required).

The meaning of "recirculate" (recirculation) is such that the energy-management system 200 circulates the carbon dioxide through the circuit assembly 201 again (repeatedly).

An example of the energy-management system 200 includes (and is not limited to) the cooling system 112, in which the carbon dioxide receives energy from the engine 102.

In accordance with the above-identified general option, the apparatus 100 is adapted so that the engine 102 is operated in such a way that: (A) the first amount of the energy is usable, at least in part, for performing the work (the work includes operatively moving the movable vehicle 101 once the engine 102 is operated to do just so), and (B) the second amount of the energy is not useable, at least in part, to perform the work of moving the movable vehicle 101 once the engine 102 is operated. The movable vehicle 101 may be any sort or type of vehicle or moving application of the engine 102.

In accordance with the above-identified general option, the apparatus 100 is adapted so that the engine 102 is operated in such a way that: (A) the first amount of the energy is usable, at least in part, for performing the work (the work includes operatively moving the movable vehicle 101 once the engine 102 is operated to do just so), and (B) the second amount of the energy is not useable, at least in part, to perform the work of moving the movable vehicle 101 once the engine 102 is operated. For example, the second amount of energy includes thermal energy. The energy-management system 200 is configured to recirculate, at least in part, the carbon dioxide relative to the engine 102 in such a way that the carbon dioxide receives and conveys the second amount of the energy away from the engine 102.

In accordance with the above-identified general option, the apparatus 100 is adapted so that the energy-management system 200 is configured to recirculate, at least in part, the carbon dioxide relative to the engine 102 in such a way that the carbon dioxide receives and conveys the second amount of the energy away from the engine 102. The engine 102 may be used in a moving application or in a stationary application.

In accordance with the above-identified general option, the apparatus 100 is adapted so that the energy-management system 200 is configured to recirculate, at least in part, the carbon dioxide relative to the engine 102 in such a way that the carbon dioxide receives and conveys the second amount of the energy away from the engine 102. The energy-management system 200 is further configured to cooperate with an energy-recovery system 400. It will be appreciated that the examples of the energy-recovery system 400 are depicted in FIGS. 4A and 4B. The cooperation between the energy-management system 200 and the energy-recovery system 400 is done in such a way that the energy-management system 200 recirculates, at least in part, the carbon dioxide through the energy-recovery system 400 via a circuit assembly 401 of energy-recovery system 400. The circuit assembly 401 and the circuit assembly 201 may be isolated from each other (indirect coupling), or may be fluidly connected to each other (direct coupling), as may be required. The energy-recovery system 400 receives, at least in part, the second amount of the energy from the carbon dioxide. The energy-recovery system 400 is configured to recover, at least in part, the second amount of the energy from the carbon dioxide. The carbon dioxide is recirculated through the energy-recovery system 400 (between the energy-management system 200 and the energy-recovery system 400) via the circuit assembly 401. It will be appreciate that the circuit assembly 201 and the circuit assembly 401 may be directly coupled together or may be indirectly coupled together (as may be required).

In accordance with the above-identified general option, the apparatus 100 is adapted so that the energy-recovery system 400 is configured to provide, at least in part, the energy recovered, at least in part, from the second amount of the energy received from the carbon dioxide for subsequent use by the engine 102 (if so desired) or fir use by other systems of the movable vehicle 101.

In view of the foregoing, it will be appreciated that in a general aspect, the apparatus 100 includes (and is not limited to) a combination of the engine and the energy-management system 200. The energy-management system 200 is configured to recirculate, at least in part, carbon dioxide relative to the engine 102 in such a way that the carbon dioxide exchanges, at least in part, energy relative to the engine 102 once the carbon dioxide is made to recirculate, at least in part, along the energy-management system 200.

Additional Description

In accordance with a general option, the apparatus includes (and is not limited to) an internal combustion engine. The internal combustion engine includes a heat-generating assembly and a cooling system. The cooling system is configured to be positioned relative to the heat-generating assembly. The cooling system is configured to recirculate a cooling medium having carbon dioxide relative to the heat-generating assembly in such a way that the carbon dioxide conveys heat from the heat-generating assembly to the cooling medium, and the cooling medium transports the heat away from the heat-generating assembly.

In accordance with an option, the apparatus 100 includes the engine 102. The engine 102 includes the heat-generating assembly 104 and the cooling system 112. The cooling system 112 is configured to be (A) positioned relative to the heat-generating assembly 104, and (B) circulate the cooling medium 116 having carbon dioxide (liquid or gas) relative to the heat-generating assembly 104. This is done in such a way that the carbon dioxide conveys heat from the heat-generating assembly 104 to the cooling medium 116. The cooling medium 116 transports the heat away from the heat-generating assembly 104.

In accordance with another option, the heat-generating assembly 104 includes the engine 102. The engine 102 defines instances of the connection passageway 202, the connection passageway 232, the connection passageway 234, the connection passageway 236 each of which are configured to convey the cooling medium 116 of the cooling system 112. This is done in such a way that the carbon dioxide absorbs and conveys heat from the engine 102 to a cooling medium 116.

The is, the cooling medium absorbs, at least in part, the heat from the engine 102. For example, the carbon dioxide absorbs and conveys heat from the engine 102 to the cooling medium 116 in a closed loop control of engine temperature to get to the optimal and most efficient engine operating point.

In accordance with another option, the apparatus 100 may further include the connecting passageway 108 configured to fluidly connect the heat-generating assembly 104 with the cooling medium 116. This is done in such a way that the cooling medium 116 of the cooling system 112 circulates, in use, between the heat-generating assembly 104 and the cooling system 112.

In accordance with another option, the apparatus 100 may further include connecting passageway 108 configured to fluidly connect the heat-generating assembly 104 with the cooling medium 116. This is done in such a way that the cooling medium 116 of the cooling system 112 circulates, in use, between the heat-generating assembly 104 and the cooling system 112. The connecting passageway 108 presents a heat exchange structure to the cooling medium 116 circulating within cooling system 112.

In accordance with another option, the apparatus 100 may further include the connecting passageway 108 configured to fluidly connect the heat-generating assembly 104 with the cooling system 112. This is done in such a way that the cooling medium 116 of the cooling system 112 circulates, in use, between the heat-generating assembly 104 and the cooling system 112. The connecting passageway 108 presents a heat-exchange structure 127 to the cooling medium 116. The heat-exchange structure 127 may include micro-cavities, including open micro-pours. The heat-exchange structure 127 may include micro-channels. For example, the heat-exchange structure defines the micro-channels. For example, the heat-exchange structure may define the micro-cavities.

In accordance with another option, the apparatus 100 may further include the connecting passageway 108 configured to fluidly connect the heat-generating assembly 104 with the cooling system 112. This is done in such a way that the cooling medium 116 of the cooling system 112 circulates, in use, between the heat-generating assembly 104 and the cooling system 112. The connecting passageway 108 presents the heat-exchange structure 127 to the cooling medium 116. A pressure-reducing device 117 is fluidic connected to the connecting passageway 108. The connecting passageway 108 is configured to: (A) receive the cooling medium 116 at pressure (or at a reduced pressure. The pressure-reducing device 117 has the cooling medium 116 in contact communication with a fluid channel in the connecting passageway 108, (B) transform from liquid by evaporating at the contact surfaces into a gas state and/or a liquid state (preferably gas state). The pressure-reducing device 117 includes a pipe or tube (by way of example).

In accordance with another option, the apparatus 100 may further include connecting a fluid source (configured to provide the cooling medium 116) to the connecting passageway 108. The connecting passageway 108 is configured to fluidly connect the heat-generating assembly 104 with the cooling system 112 in such a way that the cooling medium 116 of the cooling system 112 circulates, in use, between the heat-generating assembly 104 and the cooling system 112. The connecting passageway 108 presents the heat exchange structure to the cooling medium 116. The heat-exchange structure 127 fluidly communicates with an outlet assembly 128.

In accordance with another option, the apparatus 100 may further include a temperature sensor 118 configured to be: (A) in thermal communication with a heat-generating assembly 104, and (B) in signal communication with the control system 391. The temperature sensor 118 provides (in use) a reference set point value for the pressure-reducing device 117.

In accordance with another option, the apparatus 100 may further include the pressure sensor 122 in a fluidic communication with the cooling medium 116. The temperature sensor 118 is configured to: (A) work co-operatively with pressure-reducing device 117, and (B) regulate the mass flow of the cooling medium 116. The intake assembly 125 and the outlet assembly 128 define a path that the cooling medium 116 flows through the cooling system 112 (that is, a process of regulating mass flow).

In accordance with another option, the apparatus 100 is configured such that the cooling system 112 is further configured to transport the heat captured in a cooling vapor of the cooling medium 116 to a working-fluid connection 315 of a first compressor assembly 301.

In accordance with another option, the apparatus 100 may further include a first compressor assembly 301 configured to compress a cooling vapor of the cooling medium 116 to pressure at the exhaust port 316 of the second compressor assembly 303 above critical point for the cooling medium 116. The heat exchanger 304 is configured to: (A) thermally connect heat from the engine exhaust manifold 230 and the vapor from an exhaust port 316 of the second compressor assembly 303 in the heat exchanger 304, and (B) transport the heat captured in the vapor via the conduit 362 to the pressure-reducing gas expander 305. The pressure-reducing gas expander 305 is configured to convert a vapor kinetic energy into mechanical energy associated with a rotating shaft 370. The vapor kinetic energy is drive connected to the energy-converting device 374. The example of the energy-converting device 374 includes the electric generator 371, the mechanical flywheel 372, the compressor 373, etc.

In accordance with another option, the apparatus 100 is configured such that the pressure-reducing gas expander 305 is further configured to: (A) expand the cooling medium 116 in the supercritical state in the pressure-reducing gas expander 305, and (B) exhaust an expanded instance of the cooling medium 116 via the conduit 363 into the gas cooler 306. An expanded instance of the cooling medium 116 is at pressures above critical pressure of the cooling medium 116 in the gas cooler 306.

In accordance with another option, the apparatus 100 is further configured such that the gas cooler 306 is configured to: (A) air cool the cooling medium 116 to an environmental temperature and above the critical pressure for the cooling medium 116, (B) exchange thermal heat energy in the cooling medium 116 with the environment by dissipating heat due to relative motion of the gas cooler 306 through the air.

In accordance with another option, the gas cooler 306 is included or is a part of an outer panel assembly of the movable vehicle 101 (such as a side panel or a top panel, etc.). The gas cooler 306 is configured to dissipate heat by convection, conduction and/or radiation to the environment without using a powered fan (unassisted). The heat-exchange structure 127 of the cooling system 112 may be incorporated with thermally conductive micro-channels.

In accordance with another option, the apparatus 100 may be further adapted such that the gas cooler 306 provides an exit port that is fluidly connected to the heat exchanger 307. The gas cooler 306 is further configured to post cool the cooling medium 116 in a conduit 364. The heat exchanger 307 is further configured to: (A) cool the cooling medium 116 to substantially convert to the cooling medium 116 in the line 365 feeding the fluid distribution connector 308; and (B) deliver the cooling medium 116 to a pressure-reducing device 309 and/or a pressure-reducing device 331. The pressure-reducing device 309 delivers the cooling medium 116 into the connecting passageway 108 in such a way that the heat is absorbed from the heat-generating assembly 104.

In accordance with another option, the apparatus 100 may be further adapted such that the gas-liquid separator 312 is configured to separate gaseous state of a working fluid 381 from a liquid state 380.

In accordance with another option, the apparatus 100 may be further adapted such that the fluid distribution connector 308 is further configured to connect additional instances of the cabin-cooling loop 330 and of the cooling loop 340, along with instances of the pressure-reducing device 331 and the pressure-reducing device 392. The instances of the heat exchanger 332 and of the heat exchanger 334 are configured to absorb heat from a cabin air volume. The heat exchanger 334 is configured to: (A) absorb heat from an engine exhaust manifold 230, (B) combine the heat from the engine 102 (in the line 367), and (C) deliver the heat to a low-pressure connector 311. The combined sources of heat (that is, the engine 102, the cabin, oil, the exhausts, etc.) are combined into a single fluid flow, and total energy recovered in the pressure-reducing gas expander 305 is within the thermodynamic cycle 300.

In accordance with another option, the apparatus 100 may be further adapted such that the mass flow of the cooling medium 116 is configured to control temperature by closed-loop control of the pressure of the cooling medium 116. A temperature feedback signal from the temperature sensor 118 is used to dynamically control, based on vehicle parameters of the movable vehicle 101, operation of the pressure-reducing device 309, of the pressure-reducing device 331, and of the pressure-reducing device 392. The parameters are set by the control system 391 based on an engine load associated with the engine 102.

In accordance with another option, the apparatus 100 may be further configured such that the mass flow of the cooling medium 116 is further configured to: (A) vary the mass flow of any one of the first compressor assembly 301 and the second compressor assembly 303, and/or (B) be proportional with set temperature requirements for the heat-generating assembly 104. Based on parameters from the control system 391, a command signal to the pressure-reducing device 309 and a parameter setting is based on a signal communication from the temperature sensor 118 and the pressure sensor 122, resulting in the closed-loop control of the temperature zone of the engine 102.

In accordance with another option, the apparatus 100 is further adapted such that the combustion chamber 199 (also called the piston heat expanding volume) of the heat-generating assembly 104 is under closed-loop temperature control, by controlling the opening and the closing of the pressure-reducing device 117.

In accordance with another option, the apparatus 100 is further adapted such that the thermodynamic cycle 300 of vapor compression and energy recovery starts at a predetermined temperature set-point that is equal or is higher than a normal operating temperature set-point.

In accordance with another option, the apparatus 100 is further adapted such that the thermodynamic cycle 300 of the vapor compression and the energy recovery starts upon power-up of the engine 102. The thermodynamic cycle 300 is further configured to operate the first compressor assembly 301 and the intercooler 302 in such a way that the heated instance of the cooling medium 116 is circulated by opening the bypass valve 390 until all instances of loop components of the thermodynamic cycle 300 are heated to a predetermined temperature set point value. A heating rate is controlled by the control system 391 with electrical signal communications from the control system 391 with the controllable components of the thermodynamic cycle 300. At least the portion of the cooling medium 116 is used to heat the assemblies of the movable vehicle 101 (such as, the cabin, the structure that holds the oil, and/or the structure that holds the windshield washer fluid, etc.) The cooling medium 116 is at temperature above the environmental temperature (for the case where the environmental temperature is relatively low such as below freezing (zero degrees Centigrade).

In accordance with another option, the apparatus 100 is further configured such that the cooling medium 116 is dispensed within a plurality of fluid channels represented by the heat-exchange structure 127 is in a liquid state or a gaseous state or mixture of both states.

In accordance with another option, the apparatus 100 is further configured such that the cooling medium 116 is dispensed within a plurality of fluid channels configured to form the heat-exchange structure 127 in a form of non-continuous and subdivided liquid droplets of the cooling medium 116. The droplets may be generated by the spray-generating device 124, and may not exceed 200 micrometers (for example). The mass flow of the cooling medium 116 is controlled by the spray-generating device 124 and the pressure-reducing device 117 in a closed-loop proportional control of temperature and pressure under the operational control of the control system 391. Is done in such a way that at least one instance of the spray-generating device 124 and/or of the pressure-reducing device 117 may be placed in the each instance of the intake assembly 125.

In accordance with another option, the apparatus 100 is further configured such that the spray-generating device 124 is positioned at a margin of a plurality of the connecting passageway 108 in such a way that the cooling medium 116 is suitably spread and/or subdivided in a uniform pattern over the heat-generating assembly 104.

In accordance with another option, the apparatus 100 may include (and is not limited to) the engine 102. The engine 102 includes the engine body 218 (also called an engine block) that defines the combustion chamber 199 (also called an engine working volume). The combustion chamber 199 has an expansion volume that is surrounded, at least in part, by the cooling system 112. The connecting passageway 108 is permeable thermally connected and is arranged for evaporative cooling of the cooling medium 116. The connecting passageway 108 is configured to exchange heat between the heat-generating assembly 104 and the cooling medium 116. The cooling system 112 is structured (for example) in a form of a fluidic micro channels or thermally-conductive open porous structure. The connecting passageway 108 is permeable thermally conductive. The connecting passageway 108 includes (for example) a carbon fiber, or more preferably non-metallic fibers and nano particles suitably structured to readily conduct heat and present increase surface area to the cooling medium 116.

In accordance with another option, the apparatus 100 may further be adapted such that the cooling medium 116 is used to cool, at least in part, in the thermodynamic cycle 300. Heat energy removal and subsequent energy recovery and conversion are provided by the pressure-reducing gas expander 305. The pressure-reducing gas expander 305 may operate in a continuous cycle.

In accordance with another option, the apparatus 100 may be further adapted such that heat energy is recovered from the heat-generating assembly 104 in the thermodynamic cycle 300, and the heat energy that is recovered is used to charge an energy storage device (such as capacitors, battery, flywheel, etc.) positioned on the movable vehicle 101. The heat-generating assembly 104 may include a fuel cell, for example. The energy storage is configured to provide a source of energy for driving the movable vehicle 101.

In accordance with another option, the apparatus 100 may be further adapted such that the cooling medium 116 includes carbon dioxide, and the cooling medium 116 is configured to: (A) collect heat energy from various heat sources (such as the engine 102, exhaust systems of the movable vehicle 101, the assembly that holds the oil, the passenger cabin, etc.) via the heat exchanger 304 (in any application equivalent to the movable vehicle 101), and (B) recover that heat in the thermodynamic cycle 300 in a closed-loop cycle.

In accordance with another option, the apparatus 100 may be further adapted such that the gas cooler 306 is further configured to be cooled by air. The gas cooler 306 is configured to at least partially heat exchange thermal energy with the environment. The gas cooler 306 is a structural part of the movable vehicle 101. The movable vehicle 101 includes a vehicle skin panel or an outer surface (such as, the hood of the engine compartment).

In accordance with another option, the thermodynamic process for cooling the engine 102 includes (and is not limited to): (A) providing the cooling medium 116, including a single element, carbon dioxide or equivalent (such as an engineered nano-structured fluid) with the thermodynamic cycle 300 (operating under similar conditions to carbon dioxide), and/or (B) configuring the cooling medium to be compatible with common engine materials (such as steel, aluminum, carbon, graphite and/or composites).

In accordance with another option, the apparatus 100 may further include the cooling loop 340 configured to absorb heat from the engine exhaust manifold 230 that is in thermal communication with the engine 102 by using at least a portion of the cooling medium 116 flowing (in use) in a separate cooling loop. The fluid distribution connector 308 is fluidly connected to the low-pressure connector 311 when the heat exchanger 304 is not used.

In accordance with another option, the apparatus 100 may be configured such that the pressure-reducing device 309 includes: thermostatically controlled valves alternatively structured to use the pressure-reducing device 309 from a class of expenders suitably incorporated and mechanically connected to the rotating shaft 370 for additional energy recovery during pressure reduction of the cooling medium 116 in the connecting passageway 108.

In accordance with another option, the apparatus 100 may be configured such that the pressure-reducing gas expander 305 is further structured and/or configured to: (A) recover energy in the pressure-reducing gas expander 305, and (B) convert the energy into a pressured gas in the compressor 373 for storage and subsequent use for motive power to be used by the movable vehicle 101.

In accordance with another option, the apparatus 100 may further include the intercooler 302 configured to exchange the heat energy in the compressed gas with the suitably arranged heat-exchanging medium. The heat energy is suitably delivered to heat the cabin. The heat energy delivered to heat the cabin is available on demand immediately on powering the movable vehicle 101.

In accordance with another option, the engine 102 is cooled in the thermodynamic transcritical cycle, and uses carbon dioxide as the cooling medium 116. The engine 102 includes (and is not limited to): (A) a piston sleeve with at least one fluid conductive channel disposed in the working range of the piston assembly, and (B) a pressure-reducing device 117 configured to receive the cooling medium 116 at pressure and reduce pressure of the cooling medium 116, to be in flow communications with a fluid conductive channel of a cylinder sleeve. The engine 102 may include operations such as: (A) absorb the heat of the engine 102 by expending the instance of the cooling medium 116, (B) transport the heat captured in the vapor of the cooling medium 116 to the compressor, (C) compress the vapor to pressure above critical point of the cooling medium 116 in a supercritical state, (D) expand the supercritical state medium in the expender, and (E) convert the kinetic energy of the expending fluid into a more usable form of the energy, (F) post cool the cooling medium 116, (G) expand the cooling medium 116 in a pressure-reducing device, and (H) deliver the cooling medium 116 in fluidic communications to cooling areas of the engine 102.

In accordance with another option, the fluid conductive channels are in the vicinity of the working fuel energy conversion cavities, or at least one working cylinder in thermal communication with the cooling medium 116. A work-generating cylinder temperature is controlled by at least one electronic temperature controller in electrical communication with at least one instance of the temperature sensor 118. A referenced value of a command signal is generated and transmitted to electrically control a flow device of the cooling medium 116 to at least one expanding volume of the engine 102. The continuous cycle of vapor compression and energy recovery starts upon engine power up. The cooling medium 116 is dispensed over a heated surface cavity, and is in a liquid state and/or a gaseous state or mixture of both states. The liquid form of the cooling medium 116 is delivered in a non-continuous and incrementally subdivided dose that is suitably controlled by the fluid delivery device in a closed-loop control of the temperature and pressure of the cooling medium 116.

In accordance with another option, at least one instance of the pressure sensor 122 is placed in the single flow path of the cooling medium 116. The cooling medium 116 is delivered to the heat source of the engine 102 in the form of subdivided droplets. The heat absorbed by the expanding instance of the cooling medium 116 is carried to the expansion device and converted into the usable form of energy other than heat energy. The engine 102 has at least one temperature-controlled zone at a temperature set-point optimized for maximum (improved) efficiency of fuel conversion into mechanical power.

In accordance with another option, the engine 102 has at least one or more additional independent temperature control zones with proportional control that is set to different set point temperatures based on the increased fuel conversion factors with increased engine efficiency and increased engine performance. The engine 102 has at least one volume defined by the engine body 218, and has an expansion volume with an easily permeable metal structure suitably arranged for facilitation of carbon dioxide evaporation. The engine 102 has at least one area made of the carbon-fiber structure with increased heat thermal conductivity, and carbon structure preferably made of carbon nanotubes to facilitate heat absorption by the cooling medium 116 and increase permeability of the cylinder sleeve and strength of the cylinder sleeve (in which the sleeve is to conduct or convey the cooling medium 116).

In accordance with another option, at least one volume of the engine body 218 has a cooling chamber configured to facilitate the boiling of the cooling medium 116, where boiling flow is proportional to the commanded signal from the temperature controller. Carbon dioxide in the liquid state is used to spray over the heated surface, and to evaporate absorbing heat by absorption due to increased volume at the lower pressure, and to increase the temperature (due to latent heat of vaporization). The spray pattern is in form of the finally divided droplets not exceeding 200 micrometers in single dimension, uniformly sprayed over the heated surface. The cooling medium 116 is carbon dioxide gas in the supercritical state.

In accordance with another option, the engine 102 is cooled by the carbon dioxide that operates at optimal temperature range from very start condition, and where closed tolerances are maintained between moving components throughout the operation of the engine 102. Spray evaporative cooling is used to maintain optimal operating temperature of the engine 102. The spray of the cooling medium 116 is a mixture of the liquid portion and gas portion of carbon dioxide.

In accordance with another option, the cooling medium 116 is in thermo dynamic cycle; the carbon dioxide is used to extract the energy from the engine 102, transfer the energy to the compressor, compress the gas of the carbon dioxide to a high temperature, and extract the heat from the gas for of the carbon dioxide in a device cold expander. The expander is a digitally controlled positive displacement piston expander with digitally controlled high and low pressure ports configured to deliver constant power and/or speed output at the shaft with variable flow fluid with high efficiency by modulating opening and closing sequence of high and low pressure ports and commutating between cylinders producing adaptable demand device.

In accordance with another option, initial heating of the parts of the engine 102 and of the movable vehicle 101 may be obtained by circulating one single-phase instance of the cooling medium 116 until the optimal temperature is attained. The apparatus 100 and method provides expending the instance of the cooling medium 116 enriched with heat from the engine 102, and/or combined with the heat from the exhaust from the engine 102, and/or combined with heat from the passenger cabin and/or other heat sources, and then converting the accumulated energy into electrical energy (thus recovering what would have been previously unrecovered heating losses).

In accordance with another option, heat from the engine oil is recovered by an oil-cooling circuit. Such a recovered energy may be used to charge a battery bank of the hybrid vehicle. Such recovered energy may be used to drive the electrically-operated supercharger. The system of engine cooling includes at least one close loop with the cooling medium 116 is in fluidic communication with the heat recovery device.

In accordance with another option, the expanding medium in the pressure-reducing gas expander 305 is configured to convert the combined heat from the body of the engine 102 and the heat from the exhaust from the engine 102, and converts the heat (with high efficiency) for the pressure-reducing gas expander 305. In response, the pressure-reducing gas expander 305 is configured to generate electricity used to charge the battery of the movable vehicle 101. The expanding medium in the pressure-reducing gas expander 305 may be configured to convert the combined heat from the body of the engine 102 and heat from the exhaust from the engine 102 and converts the heat (with high efficiency) in the mechanical energy in the form of the mechanical flywheel 372. The flywheel energy can be used for accelerating the movable vehicle 101 to improve efficiency and expand the operating range of an electric vehicle by preserving batteries from deep discharge during prolonged acceleration. The expanding medium in the pressure-reducing gas expander 305 converts the combined heat from the body of the engine 102 and heat from the exhaust from the engine 102, and converts this heat with high efficiency in the pressure by powering the compressor to create a turbocharger or preferably supercharger and increase power of the engine 102. The expanding medium in the pressure-reducing gas expander 305 converts the combined heat from the body of the engine 102 and heat from the exhaust from the engine 102, and converts this heat (with high efficiency) in the energy suitable for storage and subsequent recovery and use, where storage is chemical storage of energy. The engine 102 is configured to facilitate the follow of the cooling medium 116 in engineered nano-structured fluid with the thermodynamic cycle 300 (similar to carbon dioxide but with specifically optimized for efficient cooling critical temperature and critical pressure of the cooling medium 116). Cooling of the engine 102 and heat recovery from the engine 102 with optimal temperature control, accurately controlled by closed-loop proportional temperature computer to ensure that no large temperature excursions are possible. New and lighter materials (such as, carbon graphite, and composites, etc.) may be suitably applied for the engine body 218 can be used, without deteriorating mechanical properties due to excursions in temperatures of the engine 102 due to precise temperature monitoring and temperature control.

According to an option, the apparatus 100 includes the engine 102. The engine 102 includes the heat-generating assembly 104 configured to generate heat once actuated to do just so. The cooling system 112 is configured to be positioned relative to the heat-generating assembly 104, have the cooling medium 116 including, at least in part, carbon dioxide liquid or gas, and circulate, at least in part, the carbon dioxide relative to the heat-generating assembly 104 in such a way that the carbon dioxide conveys, at least in part, heat from the heat-generating assembly 104 to the cooling medium 116 as the carbon dioxide is circulated by the cooling system 112.

According to an option, a method includes circulating a cooling medium 116 having carbon dioxide liquid or gas relative to a heat-generating assembly 104 of an engine 102 in such a way that the carbon dioxide conveys heat from the heat-generating assembly 104 to the cooling medium 116, and the cooling medium 116 transports the heat away from the heat-generating assembly 104.

According to an option, the heat-generating assembly 104 includes the piston assembly 105 configured to generate heat in the engine 102 once engaged to do just so.

According to an option, the engine 102 defines instances of the connection passageway 202, the connection passageway 232, the connection passageway 234, and the connection passageway 236 configured to convey the cooling medium 116 of the cooling system 112 in such a way that the carbon dioxide absorbs and conveys heat from the engine 102 to a cooling vapor of the cooling medium 116.

According to an option, the apparatus 100 includes a connecting passageway 108 configured to fluidly connect the heat-generating assembly 104 with the cooling medium 116 in such a way that the cooling medium 116 of the cooling system 112 circulates, in use, between the heat-generating assembly 104 and the cooling system 112.

According to an option, the connecting passageway 108 presents a heat exchange structure to the cooling medium 116 circulating within the cooling system 112.

According to an option, the heat-exchange structure 127 includes micro-cavities, including open micro-pours.

According to an option, the connecting passageway 108 presents a heat-exchange structure 127 to the cooling medium 116, and the heat exchange structure includes micro-channels.

According to an option, the apparatus 100 includes a pressure-reducing device 117 that is fluidic connected to the connecting passageway 108, and the connecting passageway 108 is configured to: receive the cooling medium 116 at pressure and reduce pressure of a cooling medium 116 by the pressure-reducing device 117 having the cooling medium 116 in a contact communication with fluid channel in the connecting passageway 108, and transform from liquid by evaporating at contact surfaces into gas/liquid or preferably gas state. The pressure-reducing device 117 includes a pipe or tube.

According to an option, the apparatus 100 includes the cooling medium 116 fluidly coupled to a fluid source to the connecting passageway 108 configured to fluidly connect the heat-generating assembly 104 with the cooling system 112 in such a way that the cooling medium 116 of the cooling system 112 circulates, in use, between the heat-generating assembly 104 and the cooling system 112. The connecting passageway 108 presents a heat exchange structure to the cooling medium 116. The heat-exchange structure 127 fluidly communicates with an outlet assembly 128.

According to an option, the apparatus 100 includes the temperature sensor 118 configured to be: in thermal communication with the heat-generating assembly 104, and in signal communication with control system 391. The temperature sensor 118 provides a reference set point value for a pressure-reducing device 117.

According to an option, the apparatus 100 includes a pressure sensor 122 in a fluidic communication with the cooling medium 116. The temperature sensor 118 is configured to: work co-operatively with pressure-reducing device 117, and regulate the mass flow of the cooling medium 116. The intake assembly 125 and the outlet assembly 128 define a path of the cooling medium 116 through the cooling system 112.

According to an option, the cooling system 112 is further configured to transport the heat captured in a cooling vapor of the cooling medium 116 to a working-fluid connection 315 of a first compressor assembly 301.

According to an option, the apparatus 100 includes a first compressor assembly 301 configured to compress a cooling vapor of the cooling medium 116 to pressure at an exhaust port 316 of the compressor above critical point for the cooling medium 116. A heat exchanger 304 is configured to thermally connect heat from an engine exhaust manifold 230 and a vapor from the exhaust port 316 of the second compressor assembly 303 in the heat exchanger 304 and transport the heat captured in the vapor via conduit 362 to a pressure-reducing gas expander 305. A vapor kinetic energy is converted to mechanical energy of a rotating shaft 370. The vapor kinetic energy is drivable connected to an energy-converting device 374 such as an electric generator 371, a mechanical flywheel 372, the compressor 373, etc.

According to an option, the apparatus 100 includes a pressure-reducing gas expander 305 configured to: expand the cooling medium 116 in the supercritical state in the pressure-reducing gas expander 305, and exhaust an expanded instance of the cooling medium 116 via a conduit 363 into a gas cooler 306. An expanded instance of the cooling medium 116 is at pressures above critical pressure of the cooling medium 116.

According to an option, the apparatus 100 includes a gas cooler 306 is configured to: air cool a cooling medium 116 to environmental temperature and above critical pressure for the cooling medium 116, and to exchange thermal heat energy in the cooling medium 116 with an environment by dissipating heat due to relative motion of the gas cooler 306 through the air. The gas cooler 306 is part of an outer panel assembly of a vehicle. The gas cooler 306 is configured to dissipate heat by convection, conduction and/or radiation to the environment without using a powered fan unassisted, and by incorporating a heat-exchange structure 127 with thermally conductive micro-channels.

According to an option, the apparatus 100 includes the gas cooler 306 exit port that is fluidly connected to a heat exchanger 307. The gas cooler 306 is further configured to post cool a cooling medium 116 in a conduit 364. The heat exchanger 307 is further configured to: cool the cooling medium 116 to substantially convert to the cooling medium 116 in line 365 feeding a fluid distribution connector 308, and deliver the cooling medium 116 to a pressure-reducing device 309 and to pressure-reducing device 331. The pressure-reducing device 309 delivers the cooling medium 116 into a connecting passageway 108 to absorb the heat from the heat-generating assembly 104.

According to an option, the apparatus 100 includes a gas-liquid separator 312 configured to separate gaseous state of a working fluid 381 from a liquid state 380.

According to an option, the apparatus 100 includes a pressure-reducing device 117, and a fluid distribution connector 308 is further configured to: connect additional instances of a loop with instances of a pressure-reducing device 331 and pressure-reducing device 392. Instances of the heat exchanger 332, 334 configured to absorb heat from a cabin air volume. The heat exchanger 334 is configured to: absorb the heat from an engine exhaust manifold 230; combine the heat from the engine 102, in a line 367, and deliver the heat to a low-pressure connector 311. The combined sources of heat, i.e. the engine 102, a cabin, oil, exhaust, etc. is combined into a single fluid flow and total energy recovered in a pressure-reducing gas expander 305 within a thermodynamic cycle 300.

According to an option, the apparatus 100 includes a mass flow of a cooling medium 116 configured to: control temperature by close loop control of pressure of the cooling medium 116. A temperature feedback signal from a temperature sensor 118 is used to dynamically control, based on vehicle parameters. The parameters are set by a control system 391 based on an engine load.

According to an option, the apparatus 100 includes a mass flow of a cooling medium 116 further configured to: vary the mass flow of any one of a first compressor assembly 301 and the second compressor assembly 303, to be proportional with set temperature requirements for the heat-generating assembly 104, and based on parameters from a control system 391. A command signal to pressure-reducing device 309 and parameter setting is based on a signal communication from a temperature sensor 118 and pressure sensor 122, resulting in a closed-loop controlled temperature zone of the engine 102.

According to an option, the apparatus 100 includes the combustion chamber 199 of the heat-generating assembly 104 is under close loop temperature control, by controlling opening and closing of a pressure-reducing device 117.

According to an option, the apparatus 100 includes a mass flow of a cooling medium 116. The thermodynamic cycle 300 of vapor compression and energy recovery starts at a predetermined temperature set-point equal or higher than normal operating temperature set-point.

According to an option, the apparatus 100 includes the thermodynamic cycle 300 of vapor compression and energy recovery starts upon power up of the engine 102, is further configured to: operate a first compressor assembly 301 and an intercooler 302 in a way to circulate the heated instance of the cooling medium 116 by opening a bypass valve 390 until all instances of loop components of the thermodynamic cycle 300 are heated to a predetermined temperature set point value. A heating rate is controlled by the a control system 391 with electrical signal communications from the control system 391 with components of the thermodynamic cycle 300, where, at least the portion of the cooling medium 116 is used to heat the cabin, the oil, and a windshield washer fluid. The cooling medium 116 is at temperature above the environmental temperature.

According to an option, the cooling medium 116 is dispensed within a plurality of fluid channels represented by heat-exchange structure 127 is in liquid or gaseous state or mixture of both states.

According to an option, the cooling medium 116 is dispensed within a plurality of fluid channels configured to form a heat-exchange structure 127, is in a form of non-continuous and subdivided liquid droplets, generated by the spray-generating device 124, not exceeding 200 micrometers. A mass flow of the cooling medium 116 is controlled by the spray-generating device 124 and a pressure-reducing device 117 in a closed-loop proportional control of temperature and pressure under control system 391 where at least one, the spray-generating device 124 and/or the pressure-reducing device 117 may be placed in the each intake assembly 125.

According to an option, the apparatus 100 includes the spray-generating device 124 positioned at a margin of a plurality of connecting passageway 108 suitably spreading subdivided instance of the cooling medium 116 in uniform pattern over the heat-generating assembly 104.

According to an option, the apparatus 100 includes an engine body 218 defining a combustion chamber 199 having an expansion volume surrounding a cooling system 112, at least in part, with the connecting passageway 108 being permeable thermally connected and arranged for evaporative cooling, being configured to exchange heat between a heat-generating assembly 104 and a cooling medium 116. The cooling system 112 is structured in a form of a fluidic micro channels, or thermally conductive open pores structure. A connecting passageway 108 is permeable thermally conductive, and includes a carbon fiber, or more preferably non-metallic fibers and nano particles suitably structured to readily conduct heat and present increase surface area to the cooling medium 116.

According to an option, the cooling medium 116 is used to cool, at least in part, in a thermodynamic cycle 300. A heat energy removal and subsequent energy recovery and conversion in pressure-reducing gas expander 305, is a continuous cycle.

According to an option, the heat energy recovered from heat source in a thermodynamic cycle 300 is used to charge energy storage, i.e. capacitors, battery, flywheel, etc. on a vehicle, where the heat source is a fuel cell. The energy storage provides driving source of energy for the movable vehicle 101.

According to an option, the cooling medium 116 is configured to: collect heat energy from various heat sources, i.e. the engine 102, exhausted, oil, cabin, etc. via heat exchanger 304 in an application being equivalent to a vehicle, and recover that heat in a thermodynamic cycle 300 in a close loop cycle.

According to an option, the gas cooler 306 is further configured to be cooled by air. The gas cooler 306 is configured to at least partially heat exchange some thermal energy with an environment. The gas cooler 306 is structural part of the movable vehicle 101, such as a vehicle skin panel outer surface (i.e. hood).

According to an option, a thermodynamic process for cooling an engine is provided. The process includes having a coolant include a single element, carbon dioxide, or equivalent, engineered nano-structured fluid with thermodynamic cycle 300 similar to carbon dioxide. The process also includes configuring the coolant to be compatible with common engine materials, i.e. steel, aluminum, carbon, graphite and/or composites.

According to an option, a cooling loop 340 is configured to absorb heat from an engine exhaust manifold 230 in thermal communication with the engine 102 by using at least a portion of a cooling medium 116 in a separate cooling loop, and fluidly connecting to a fluid distribution connector 308 and low-pressure connector 311, when a heat exchanger 304 is not used.

According to an option, a pressure-reducing device 309 includes: thermostatically controlled valves alternatively structured to use the pressure-reducing device 309 from a class of expenders suitably incorporated and mechanically connected to a rotating shaft 370 for additional energy recovery during pressure reduction before the cooling medium 116 in a connecting passageway 108.

According to an option, a pressure-reducing gas expander 305 is further structured to recover energy in the pressure-reducing gas expander 305 and convert the energy into a pressured gas, in a compressor 373 for storage and subsequent use for motive power.

According to an option, an intercooler 302 is configured to heat exchange heat energy in a compressed gas with a suitably arranged heat exchanging medium, wherein the heat energy is suitably delivered to heat cabin, and where the heat energy to heat cabin is available on demand immediately on powering a vehicle.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly, components, or software code that is superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) description provided outside of this document (that is, outside of the instant application as filed, as prosecuted, and/or as granted). It is understood, for the purposes of this document, the phrase "includes" is equivalent to the word "comprising." It is noted that the foregoing has outlined the non-limiting embodiments (examples). The description is made for particular non-limiting embodiments (examples). It is understood that the non-limiting embodiments are merely illustrative as examples.

What is claimed is:

1. A energy management apparatus for a combustion chamber of an internal combustion engine, comprising:

a heat exchange structure at least partially surrounding the combustion chamber; and a cooling system including a pressurized carbon dioxide cooling medium, at least one pressure-reducing device, at least one intake assembly connected between the pressure reducing device and the heat-exchange structure, a spray-generating device within each intake assembly, the spray-generating device introducing droplets of the cooling medium into the heat-exchange structure, at least one outlet assembly extending from the heat exchange structure being spaced apart from the intake assembly, a control system for controlling the temperature of the engine and the temperature and pressure of the cooling medium, a closed-loop circulation circuit conveying the carbon dioxide cooling medium from the at least one outlet assembly to the at least one pressure reducing device, wherein the mass flow of the cooling medium through the closed-loop circulation circuit is controlled by the at least one spray-generating device and the at least one pressure-reducing device under operational control of the control system.

2. The apparatus of claim 1, wherein: the engine is included in a movable vehicle.

3. The apparatus of claim 1 further comprising a piston assembly which generates heat in the engine and the cooling system is positioned proximate to the piston assembly.

4. The apparatus of claim 1, wherein the heat-exchange structure comprises micro-cavities which receive the carbon dioxide cooling medium.

5. The apparatus of claim 1, wherein the heat-exchange structure comprises micro-channels which receive the carbon dioxide cooling medium.

6. The apparatus of claim 1, wherein the cooling system includes a temperature sensor in thermal communication with the piston assembly and in signal communication with the control system, the temperature sensor transmits a signal to the control system indicating a reference set point value for the pressure-reducing device.

7. The apparatus of claim 6, wherein the cooling system includes a pressure sensor in a fluidic communication with the carbon dioxide cooling medium; and the temperature sensor configured to work co-operatively with the pressure sensor and with the pressure-reducing device to regulate the mass flow of the carbon dioxide cooling medium through the cooling system.

8. The apparatus of claim 1, wherein:

the cooling system is operatively coupled to a first compressor assembly wherein the carbon dioxide cooling medium transports heat captured from the outlet assembly to the first compressor assembly, and the first compressor assembly compresses the carbon dioxide cooling medium received from the cooling system at a pressure above a critical point for the carbon dioxide cooling medium.

9. The apparatus of claim 8, wherein:

the first compressor assembly is operatively coupled to the heat exchange structure via a second compressor assembly, the carbon dioxide cooling medium passes through the heat exchange structure to a pressure-reducing gas expander in which kinetic energy from the heated carbon dioxide cooling medium is converted into mechanical energy used to rotate a rotating shaft, and the rotating shaft is configured to drive an energy-converting device.

10. The apparatus of claim 9, wherein:

the pressure-reducing gas expander expands the carbon dioxide cooling medium in a supercritical state and exhausts an expanded instance of the carbon dioxide to a gas cooler in which the expanded instance of the carbon dioxide cooling medium is at the pressure above a critical pressure of the carbon dioxide.

11. The apparatus of claim 10, wherein: the gas cooler air cools the carbon dioxide to an environmental temperature above the critical pressure for the carbon dioxide; and exchanges thermal energy in the carbon dioxide cooling medium with the environment by dissipating heat due to relative motion of the gas cooler through air.

12. The apparatus of claim 11, wherein:

the gas cooler is fluidly connected to the heat exchange structure, and the gas cooler further cools the carbon dioxide cooling medium leaving the heat exchange structure.

13. The apparatus of claim 1, wherein: the cooling system connects to a gas-liquid separator wherein the carbon dioxide in a gaseous state is separated from the carbon dioxide in a liquid state.

14. The apparatus of claim 1 wherein the carbon dioxide cooling medium in the closed-loop circuit absorbs heat energy generated in the internal combustion engine by evaporative cooling.

15. The apparatus of claim 14 wherein the carbon dioxide cooling medium absorbs heat energy generated by additional sources of waste heat along the closed-loop circulation circuit.

16. The apparatus of claim 14 further comprising a cabin-cooling loop connected to the closed-loop circulation circuit wherein the carbon dioxide cooling medium flows through the cabin-cooling loop and absorbs heat from a passenger cabin of a movable vehicle.

17. The apparatus of claim 16 wherein the cabin-cooling loop is connected to the closed-loop circulation circuit at a fluid distribution connector and a low-pressure connector to return the carbon dioxide cooling medium to the closed-loop circulation circuit.

18. The apparatus of claim 17 wherein the cabin-cooling loop further comprises a pressure-reducing device and a heat exchanger.

19. The apparatus of claim 17 further comprising a cooling loop connected to the closed-loop circulation circuit wherein the carbon dioxide cooling medium flows through the cooling loop and absorbs heat from a passenger cabin of a movable vehicle or delivers heat to the passenger cabin.

20. The apparatus of claim 19 wherein cooling loop is connected to the closed-loop circulation circuit at the fluid distribution connector and the low-pressure connector to return the carbon dioxide cooling medium to the closed-loop circulation circuit.

21. The apparatus of claim 20 wherein the cooling loop further comprises a pressure-reducing device, and a heat exchanger.

22. The apparatus of claim 21 wherein additional loops for cooling the vehicle are connected to the closed-loop circulation circuit at the fluid distribution connector and the low-pressure connector to return the carbon dioxide cooling medium to the closed-loop circulation circuit.

23. The apparatus of claim 22 wherein the cooling medium from all loops is combined into a single fluid flow of carbon dioxide cooling medium within the closed-loop circulation circuit and the single fluid flow of carbon dioxide cooling medium is directed into a pressure-reducing gas expander to recover heat energy from the cooling medium.

24. The apparatus of claim 14 further comprising:

a first compressor assembly;

an intercooler; and a bypass valve;

wherein upon power up of a vehicle, the first compressor assembly and intercooler circulate at least a portion of the carbon dioxide cooling medium by opening the bypass valve to permit heating and circulation of the carbon dioxide cooling medium until the components of the closed-loop circulation circuit are heated to a predetermined temperature set point value, the control system controls a heating rate of the components of the closed-loop circulation circuit.

25. The apparatus of claim 24 wherein at least a portion of the carbon dioxide cooling medium is used to heat a cabin, a vehicle oil source, and a windshield washer fluid of a vehicle.

26. The apparatus of claim 14 further comprising:

a temperature sensor; and a temperature feedback signal, wherein the control system modulates the mass flow of the carbon dioxide cooling medium with respect to feedback from the temperature feedback signal of the temperature sensor based on a vehicle's parameters set by the control system.

27. The apparatus of claim 1 wherein the spray-generating device produces droplets of carbon dioxide cooling medium not more than 200 micrometers.

28. A method of cooling a combustion chamber of an internal combustion engine with a heat-exchange structure at least partially surrounding the combustion chamber, the method consisting of:

circulating a cooling medium containing carbon dioxide in a closed-loop circuit of a cooling system, dropping the pressure of the carbon dioxide cooling medium with a pressure-reducing device, and thereafter directing the carbon dioxide cooling medium into the heat-exchange structure partially surrounding the combustion chamber to draw the heat away from the combustion chamber.

* * * * *